United States Patent [19]

Ikeda

[11] 3,982,376

[45] Sept. 28, 1976

[54] APPARATUS FOR FILLING AND SEALING RETORT FOODS

[75] Inventor: Masaomi Ikeda, Yokohama, Japan

[73] Assignee: Toyo Seikan Kaisha Limited, Tokyo, Japan

[22] Filed: June 27, 1975

[21] Appl. No.: 591,258

[30] Foreign Application Priority Data

Sept. 4, 1974 Japan ..... 49-101605

[52] U.S. Cl. ..... 53/53; 53/55; 53/239; 53/385; 141/157

[51] Int. Cl.[2] ..... B65B 57/02; B65B 3/12; B65B 43/36

[58] Field of Search ..... 53/55, 53, 63, 239, 53/266, 385, 386; 141/157

[56] References Cited

UNITED STATES PATENTS

| | | | |
|---|---|---|---|
| 2,795,906 | 6/1957 | Harker | 53/239 X |
| 2,952,959 | 9/1960 | Piazze | 53/63 X |
| 2,957,289 | 10/1960 | Monroe et al. | 53/266 X |
| 3,427,780 | 2/1969 | Bock | 53/63 |
| 3,789,574 | 2/1974 | Weikest | 53/63 |
| 3,879,920 | 4/1975 | Langen | 53/63 |

*Primary Examiner*—Leon Gilden
*Attorney, Agent, or Firm*—Frank J. Jordan

[57] ABSTRACT

A filling and sealing process and apparatus for retort foods, in which a plurality of retort pouches are treated at the same time. The retort pouches are gripped by a plurality of grippers fixedly connected to an endless transfer chain and fed through first, second, third, fourth, fifth, sixth, seventh and eighth stations. The endless transfer chain is arranged to be intermittently movable around the outer periphery of a platform mounted on a base. At the first station, a plurality of retort pouches are gripped by the grippers and opened and dilated at the second station. The opened retort pouches are fed to third station where a defectively opened retort pouch is sensed and released from the gripper. The retort pouches gripped by the grippers are fed to the fourth station, where solid food materials are introduced into the retort pouches. At the fifth station, the retort pouches are supplied with viscous liquid. The retort pouches containing solid materials and viscous liquid are fed to the sixth station, where the remaining air is released from the pouches and the openings of the respective pouches are primarily sealed. At the seventh station, the openings of the respective pouches are secondarily sealed and, at the eighth station, the sealed portions of the pouches are cooled so that the sealed portions are solidified and subsequently released from the grippers. Each step of the process at the respective stations is performed in synchronism with the intermittent movements of the transfer chain so that the plurality of retort pouches are treated at the same time at each step.

18 Claims, 27 Drawing Figures

APPARATUS FOR FILLING AND SEALING RETORT FOODS

The present invention relates in general to a process and apparatus for filling and sealing retort foods and, more particularly, to an improved process and apparatus for filling and sealing retort foods including solid materials and viscous liquid.

It has heretofore been proposed to fill cooked foods in a retort pouch and seal the pouch. After the sealing, the retort pouch is exposed to high temperature for sterilizing treatment. This retort pouch is in practice heated to an increased temperature in a boiled water so that the cooked foods can be easily obtained. The retort foods in the pouch can be quickly prepared as a meal and easily treated for sterilization. For this reason, the demand for the retort foods has been increasing and it is required that the retort foods can be produced on the mass production basis in a simplified and inexpensive manner.

In a prior art, it has been proposed to provide an apparatus for treating retort foods. This apparatus is equipped with a turn table on which several stations are provided at spaced positions for performing each step of the treatment. The turn table is usually formed in circular in cross section and become massive in size in order to prepare a large amounts of retort foods automatically at high speed.

It is, therefore, an object of the present invention to provide a process for filling and sealing retort foods in a rationalized manner.

It is another object of the present invention to provide a process for filling and sealing retort foods on the mass production basis at a high speed.

It is another object of the present invention to provide a process for filling and sealing retort foods automatically, which is able to be performed by a minimum number of persons.

It is a further object of the present invention to provide an apparatus for filling and sealing retort foods which is simplified in construction and economical to manufacture.

It is a further object of the present invention to provide an apparatus for filling and sealing retort foods at high speed.

It is a further object of the present invention to provide an apparatus for filling and sealing retort foods automatically in a simplified manner.

It is a still further object of the present invention to provide an apparatus for filling and sealing retort foods, which apparatus includes a plurality of stations provided in a spaced relationship along a travelling path of a retort pouch which is fed by an endless transfer chain intermittently movable along an outer periphery of a platform mounted on a base.

It is a still further object of the present invention to provide an apparatus for filling and sealing retort foods, which apparatus includes a plurality of treating devices or units which are operated in synchronism with an intermittent movement of an endless transfer chain movable around an outer periphery of a platform.

It is a still further object of the present invention to provide an apparatus for filling and sealing retort foods, which apparatus includes a plurality of grippers fixedly connected to an endless transfer chain which grippers are arranged to quickly and reliably grip retort pouches.

It is a still further object of the present invention to provide an apparatus for filling and sealing retort foods, which apparatus includes a pouch supplying device which supplies retort pouches to grippers in reliable manner.

It is a still further object of the present invention to provide an apparatus for filling and sealing retort foods, which apparatus includes an actuating device to actuate grippers to cause the same to smoothly grip or release retort pouches without causing damages to the retort pouches.

It is a further object of the present invention to provide an apparatus for filling and sealing retort foods, which apparatus includes a pouch opening device which is arranged to open retort pouches to a predetermined degree in a smooth fashion without causing damages to the retort pouches.

It is a further object of the present invention to provide an apparatus for filling and sealing retort foods, which apparatus includes a sealing device arranged to seal the opening portions of respective retort pouches in smooth and reliable manner without causing damages to the retort pouches.

These and other objects, features and advantages of the present invention will become more apparent from the following description when taken in conjunction with the accompanying drawings, in which.

Figure 1:
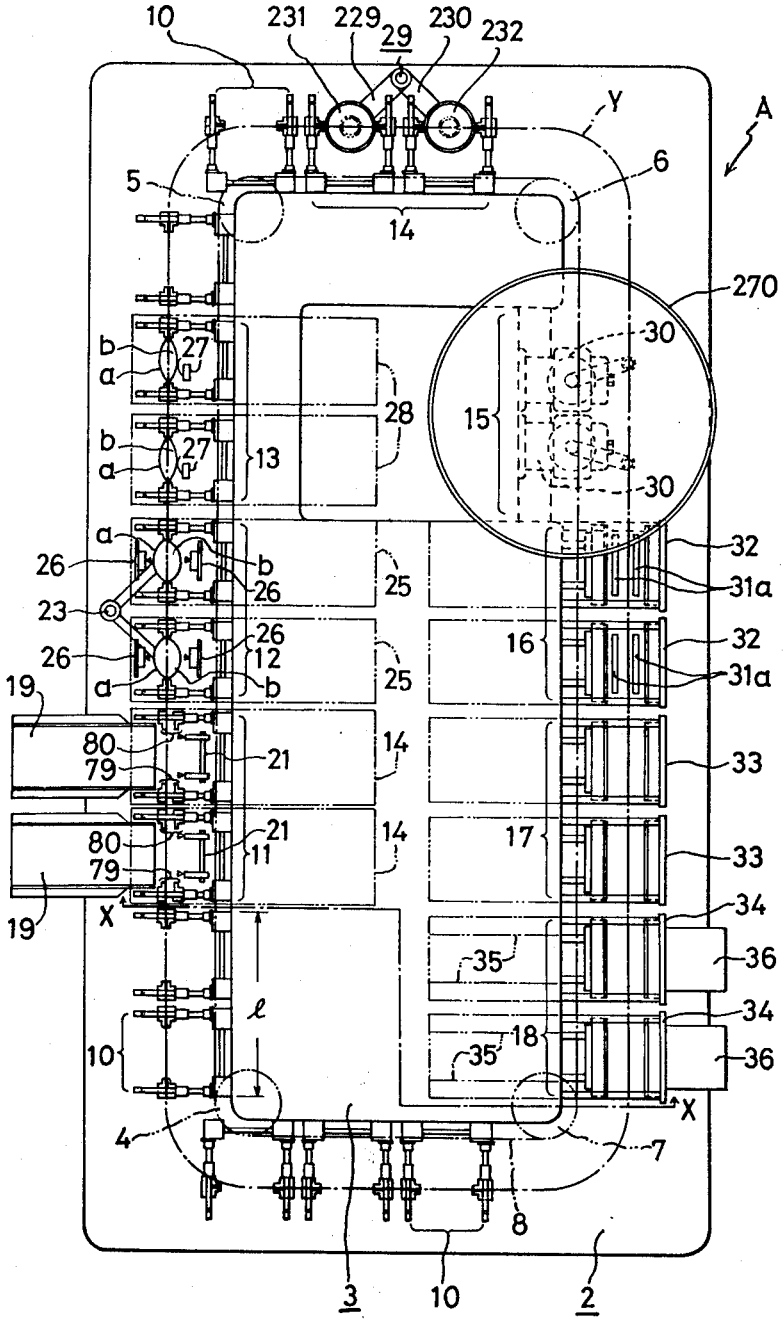
FIG. 1 is a schematic view showing a preferred embodiment of an apparatus according to the present invention carrying out a process of the present invention.
Figure 2:
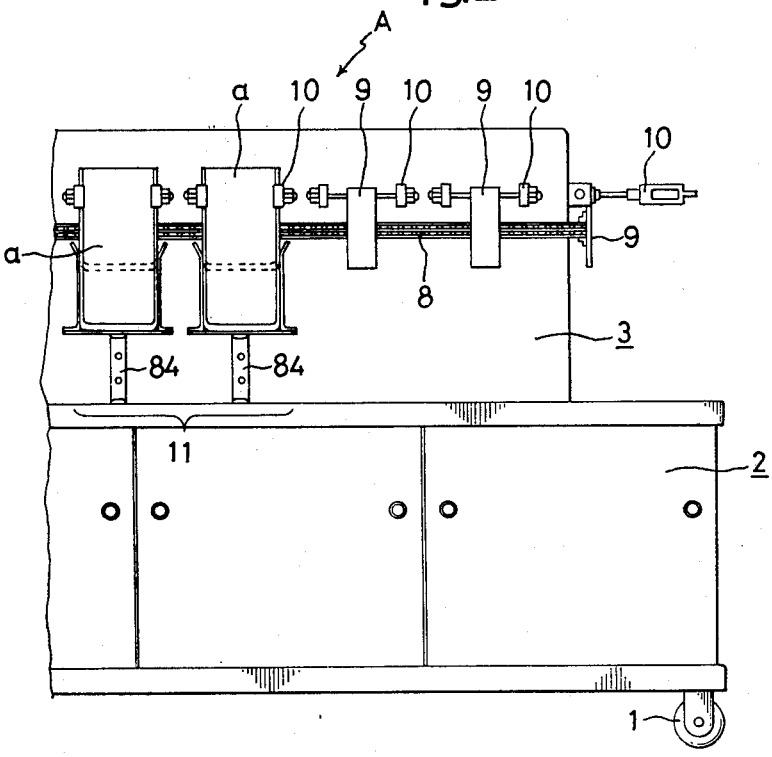
FIG. 2 is a fragmentary view illustrating a part of the apparatus shown in FIG. 1.
Figure 3:
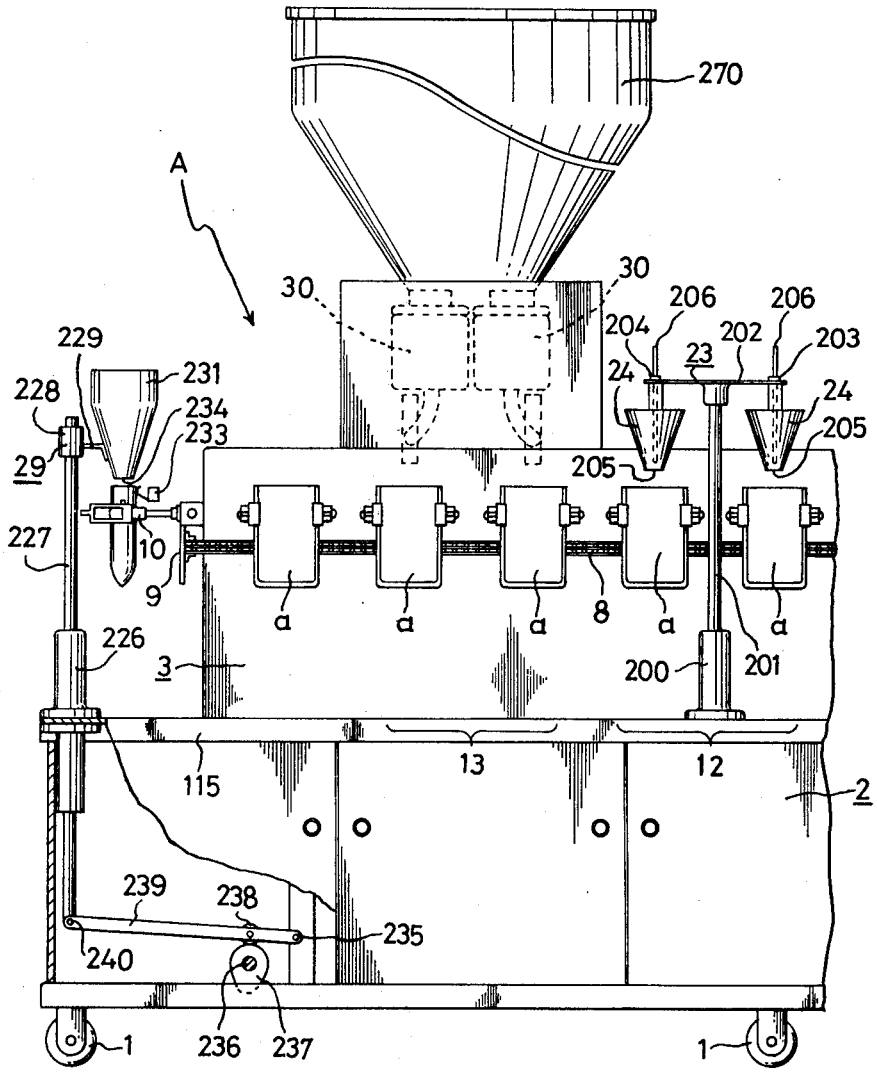
FIG. 3 is a fragmentary view illustrating another part of the apparatus shown in FIG. 1.

Referring now to FIGS. 1 through 3, there is schematically shown a preferred embodiment of an apparatus according to the present invention. The apparatus which is generally designated at A is shown to have a plurality of casters 1, by which a base 2 is movably supported. A platform 3 is fixedly mounted on the base 2. The platform 3 is provided with a driving sprocket 4 at one corner thereof and pulleys 5, 6 and 7 at the other corners thereof. An endless transfer means such as an endless chain 8 is movably supported by the driving sprocket 4 and the pulleys 5, 6 and 7 at the outer periphery of the platform 3. A plurality of vertical plates 9 are fixed to the endless transfer chain 8 in a spaced relationship. As best shown in FIG. 2, each of gripper means 10 is mounted on each of the vertical plates 9 at an upper portion thereof for gripping side edges of a pouch a. The apparatus A comprises first, second, third, fourth, fifth, sixth, seventh and eighth stations 11, 12, 13, 14, 15, 16, 17 and 18, which are provided on the base 2 along the endless transfer chain 8. The first station 11 comprises a pair of pouch stackers 19 fixedly mounted on the base 2, a pouch supplying device 20 having a pair of vacuum suction members 21 facing the forward ends of the pouch stackers 19, and a pair of gripper actuating devices 22 mounted on the platform 3 (see FIGS. 7 through 9). The second station 12 comprises a pouch dilating device 23 including a pair of air funnels 24 which are positioned above the pouches a, and a pair of pouch opening devices 25 each having a pair of vacuum suction members 26 disposed in spaced relationship. The third station 13 comprises a pair of sensors 27 which are disposed in spaced relationship along the endless transfer chain 8, and a pair of gripper releasing devices 28 which are disposed in spaced relationship along the endless chain 8. The fourth station 14 comprises a solid material throwing device 29. The fifth station 15 comprises a pair of viscous liquid filling devices 30 which are disposed along the endless transfer chain 8. The sixth station 16 comprises a pair of deflating devices 31 each having a pair of pressure plates 31a and a pair of sealing devices 32. The seventh station 17 comprises a pair of sealing devices 33 disposed along the endless chain 8. The eighth station 18 comprises a pair of sealing devices 34, a pair of gripper releasing devices 35 and a pair of shoots 36.

It should be appreciated that the first, second, third, fourth, fifth, sixth, seventh and eighth stations are positioned at predetermined locations in dependence on a pitch $l$ for which the endless chain 8 is intermittently moved. In the preferred embodiment of the present invention, the first, second and third stations 11, 12 and 13 are located in order along the endless chain 8 with the each station having the pitch $l$. The fourth station 14 is located at a position spaced from the third station 13 with a distance equal to the pitch $l$. Likewise, the fifth station 15 is located along the endless chain 8 at a position spaced from the fourth station 14 with a distance equal to the pitch $l$. The sixth, seventh and eighth stations 16, 17 and 18 are located along the endless chain 8 in contiguous relationship with each other, each station having the pitch $l$.

It should also be understood that while in the preferred embodiment of the present invention each station will be shown and described as having a pair of gripper means 10 which are intended to treat two retort pouches a concurrently but more than two retort pouches may be concurrently treated by providing more than two gripper means.

Figure 4:
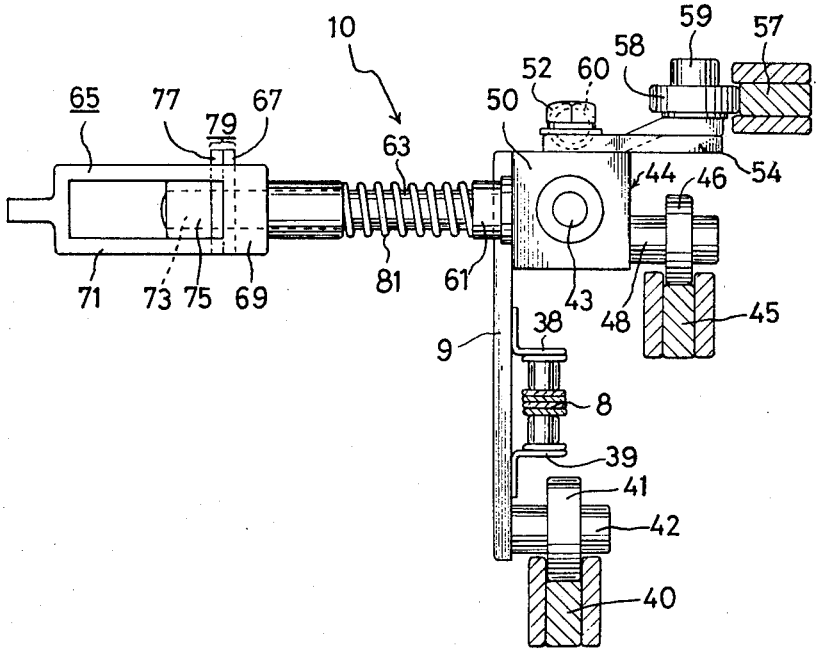
FIG. 4 is an enlarged schematic view of a gripper forming part of the apparatus shown in FIG. 1.
Figure 5:
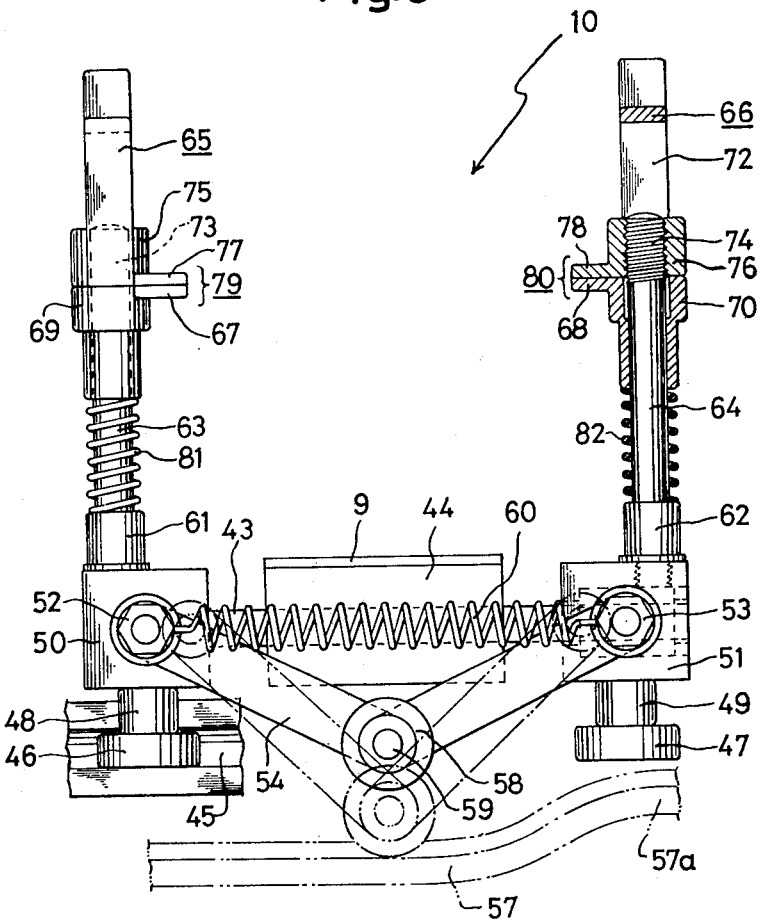
FIGS. 5 and 6 are views partly in cross section of the gripper shown FIG. 4.
Figure 6:
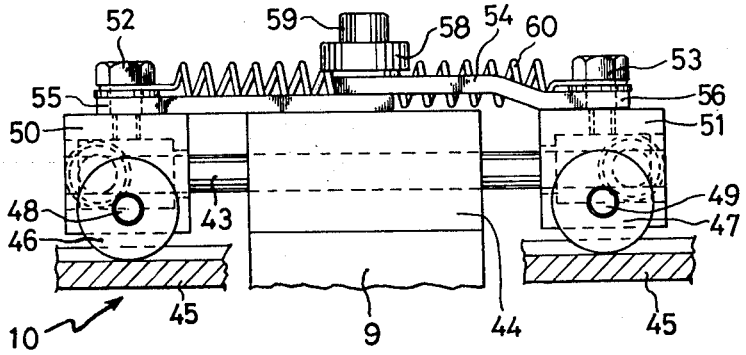

FIGS. 4 through 6 illustrate a preferred example of each of the gripper means 10 employed in the apparatus according to the present invention. As shown, the gripper means 10 is mounted on the vertical plate 9 at the upper portion thereof. The vertical plate 9 is connected to the endless transfer chain 8 by means of flange portions 38 and 39. A shaft 42 is mounted at the lower portion of the vertical plate 9, and a roller 41 is rotatably supported on the shaft 42. The roller 41 is rotatably disposed on and guided by a guide rail 40 provided on a side wall of the platform 3. As best shown in FIGS. 5 and 6, a supporting block 44 is mounted on the vertical plate 9 at an upper portion thereof and has a horizontally extending bore (no numeral) through which a shaft 43 extends. The shaft 43 carries at both ends thereof a pair of slidable blocks 50 and 51, on which guide rollers 46 and 47 are rotatably mounted by means of shafts 48 and 49, respectively. The guide rollers 46 and 47 are rotatably disposed on a guide rail 45 mounted on an upper surface of the platform 3 along the transfer chain 8. The slidable blocks 50 and 51 are connected to end portions 55 and 56 of a toggle joint 54 by means of suitable fastener means such as bolts 52 and 53, respectively. As best shown in FIGS. 5 and 6, the toggle joint 54 has a pin 59 carrying thereon a cam follower 58 which is held in contact engagement with a cam 57 in the form of a rail mounted on the upper surface of the platform 3. The toggle joint 54 also has an urging means such as a tension spring 60 which is mounted between the ends 55 and 56 of the toggle joint 54 to urge the slidable blocks 50 and 51 inwardly so that the cam follower 58 is held in a position as shown by a phantom line in FIG. 5. As the cam follower 58 is moved to a raised portion 57a of the cam 57, the cam follower 58 is moved to a position shown by a solid line in FIG. 5 so that the slidable blocks 50 and 51 are moved away from each other against the action of the tension spring 60. As best shown in FIG. 5, arms 63 and 64 horizontally extend from the blocks 50 and 51, respectively. The arms 63 and 64 carries at their end portions gripping members 79 and 80. The gripping member 79 is comprised of a slidable sleeve 69 having an inwardly extending pinching projection 67, and a nut 75 having an inwardly extending pinching projection 77 which is aligned with the pinching projection 67 of the slidable sleeve 69. The nut 75 is screwed onto a thread portion 73 of the arm 63. Likewise, the gripping member 80 is comprised of a slidable sleeve 70 having inwardly extending pinching projection 68, and a nut 76 having an inwardly extending pinching projection 78. The nut 76 is screwed onto a threaded portion 74 of the arm 64.

As shown, suitable urging means such as compression springs 81 and 82 are disposed on the arms 63 and 64 between the sleeves 61 and 69 and between the sleeves 62 and 70, respectively, for thereby urging the sleeves 69 and 70 toward the nuts 75 and 76 respectively. It will be noticed that the pinching projections 67 and 77 grasp one side of the pouch and the pinching projections 68 and 78 grasp the other side of the pouch.

Figure 7:
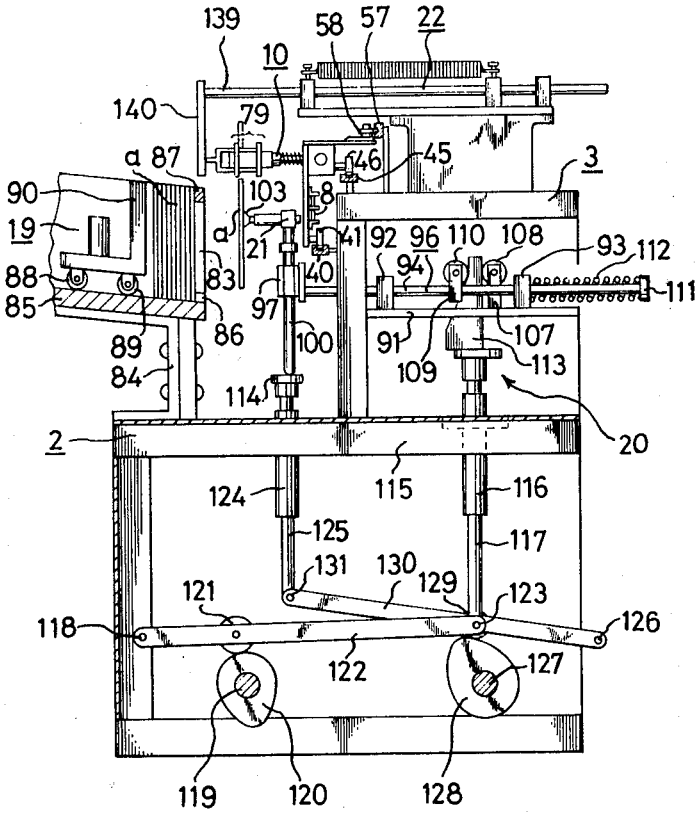
FIG. 7 is a schematic view illustrating a pouch supplying device and a gripper actuating device of the apparatus shown in FIG. 1.

As shown in FIG. 7, each of the pouch stackers 19 provided at the first station 11 has a bottom wall 85 mounted on the base 2 by a support member 84 and an opening 83 to supply a pouch a. The stacker 19 is provided at its opening 83 with stoppers 86 and 87. A biasing plate 90 is rotatably supported on rollers 88 and 89 which are disposed on the inclined bottom wall 85 of the stacker 19 and biases the pouches a toward the stoppers 86 and 87.

Figure 8:
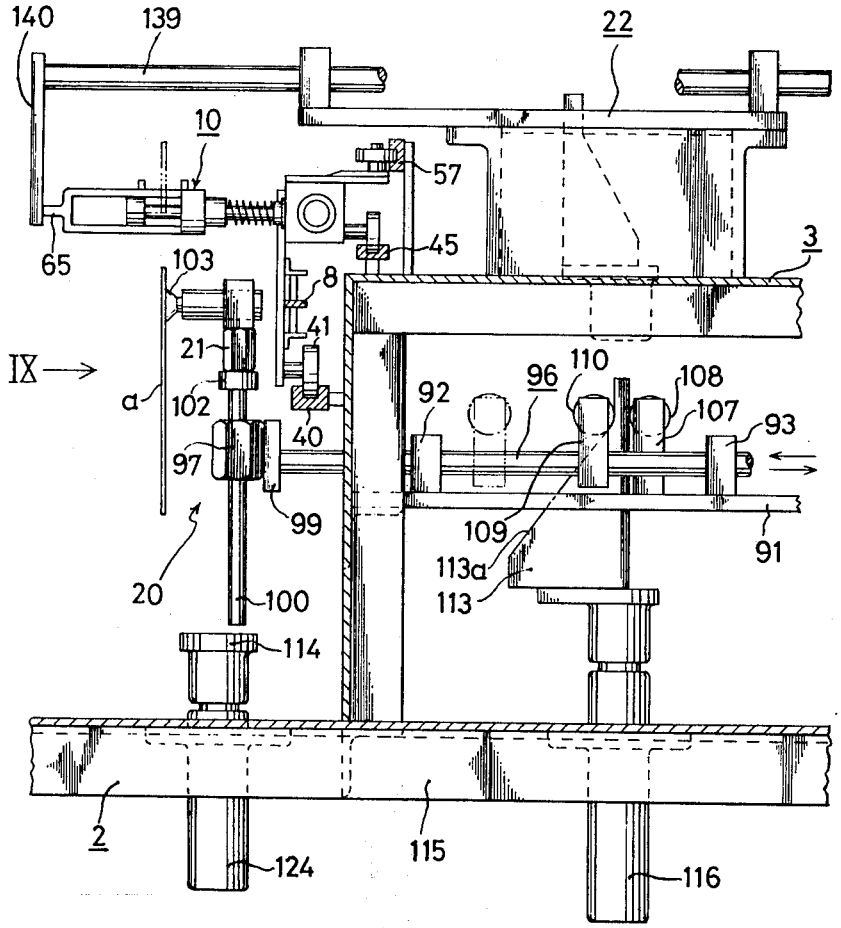
FIG. 8 is an enlarged view partly in cross section of the devices shown in FIG. 7.
Figure 9:
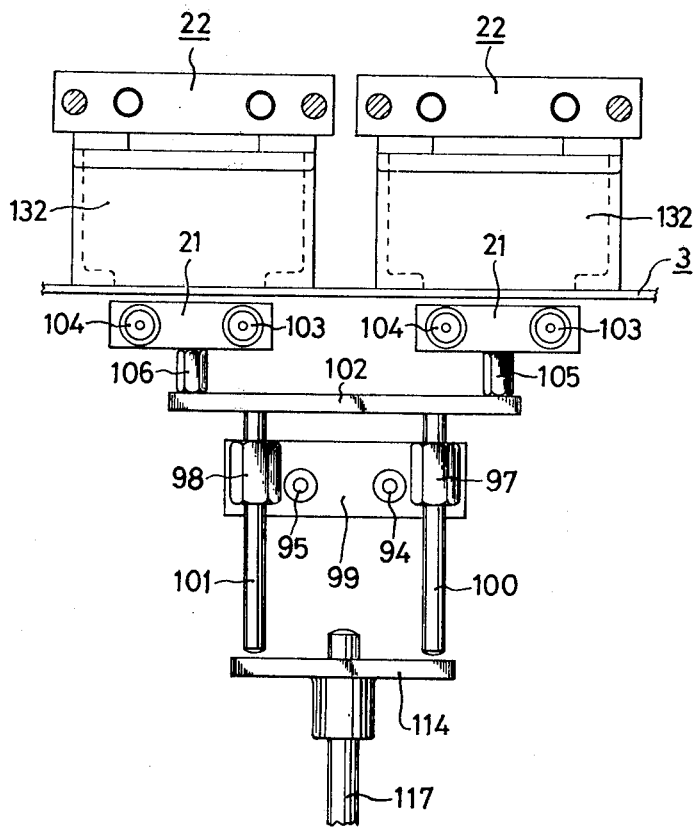
FIG. 9 is a plan view of the devices shown in FIG. 8.

As shown in FIGS. 7 through 9, the pouch supplying device 20 includes two pairs of fixed blocks 92 and 93 which are mounted on a frame 91 located within the platform 3. Shafts 94 and 95 are slidably received in bore (no numeral) formed in the fixed blocks 92 and 93 and constitute sliders 96. A mounting plate 99 is connected to one end of each of the sliders 96 and carries supporting sleeve 97 and 98. The supporting sleeves 97 and 98 respectively have bores, in which vertical shafts 100 and 101 are slidably received. The vertical shafts 100 and 101 are connected to and support a support plate 102, on which the vacuum suction members 21 are fixedly supported by means of members 105 and 106 at both ends of the plate 102. Each of the suction members 21 has a pair of vacuum cups 103 and 104 facing the opening of the pouch stacker and is connected to a suitable vacuum source, though not shown.

As best shown in FIGS. 7 and 8, stationary blocks 107 are mounted on the frame 91 adjacent the sliders 96, respectively, and a laterally extending roller 108 is rotatably supported by the stationary blocks 107. A roller 110, which extends in parallel to the roller 108 and acts as a cam follower, is rotatably supported by arms 109 fixedly connected to the shafts 94 and 95. As shown in FIG. 7, each of the shafts 94 and 95 has a spring seat 111 at an extreme end thereof and a spring means 112 is disposed on each of the shafts 94 and 95 between the block 93 and the spring seat 111 so that each of the shafts 94 and 95 is urged rightward as viewed in FIG. 7 and accordingly the vacuum suction units 21 are urged in the same direction to assume a position shown in FIG. 7. As shown, a cam plate 113 having a tapered cam surface 113a is provided in engagement with the rollers 108 and 110, so that, when the cam plate 113 is moved upward, the roller 110 is moved apart from the roller 108 against the action of the compression springs 112 and the sliders 96 are moved leftward whereby the vacuum cups 103 and 104 of the vacuum suction units 21 are moved toward the opening 83 of the pouch stacker 19. In this instance, the retort pouches a are taken out of the each of the pouch stackers 19 by the actions of the vacuum cups 103 and 104 into which the vacuum is supplied from the vacuum source. On the contrary, when the cam plate 113 is moved downward, the sliders 96 and accordingly the vacuum suction units 21 moved to a rightmost position so that the retort pouches a retracted by the cups 103 and 104 are positioned below the gripping members 79 and 80. Under these circumstances, if the vertical shafts 100 and 101 are slidably moved upward, the vacuum suction units 21 and accordingly the vacuum cups 103 and 104 are vertically moved to a position in which side edges of each of the retort pouches a are located between the gripping members 79 and 80 of the gripper 10. It is to be noted in this instance that the gripper members 79 and 80 are held in opened conditions by the action of the gripper actuating devices 22 as best shown in FIGS. 7 and 8. Each of the gripper actuating device 22 is arranged to cause each of the gripping members 79 and 80 to close thereby gripping the side edges of the pouch a.

The vertical movement of the cam plate 113 is controlled by a shaft 117 slidably disposed in a sleeve 116 fixed to the upper frame 115 of the base 2. The shaft 117 is connected at its lower end to one end of a shifter rod 122 by means of a pin 123. The shifter rod 122 is also pivotally connected at its other end to the base 2 by means of a pivot shaft 118. The shifter rod 122 carries at its intermediate portion a cam follower 121, which is held in engagement with a cam 120 rotatable with a drive shaft 119. It should be noted that the drive shaft 119 is driven in relation to an intermittent movements of the transfer chain 8. The vertical movement of the shafts 100 and 101 is controilled by a control shaft 125 slidably disposed in a sleeve 124 fixed to the upper frame 115 of the base 2. The control shaft 125 is provided at its top end with a plate 114 with which the lower end of the each of the shafts 100 and 101 is engageable. The control shaft 125 is connected at its lower end with one end of a shifter lever 130 by means of a pin 131. The shifter lever 130 is connected at its other end with the base 2 by means of a pivot pin 126. The shifter lever 130 carries thereon a cam follower 129 which is engageable with a cam 128 rotatably mounted on a drive shaft 127. The drive shaft 127 is driven in relation to the intermittent circular movements of the endless transfer chain 8.

Figure 10:
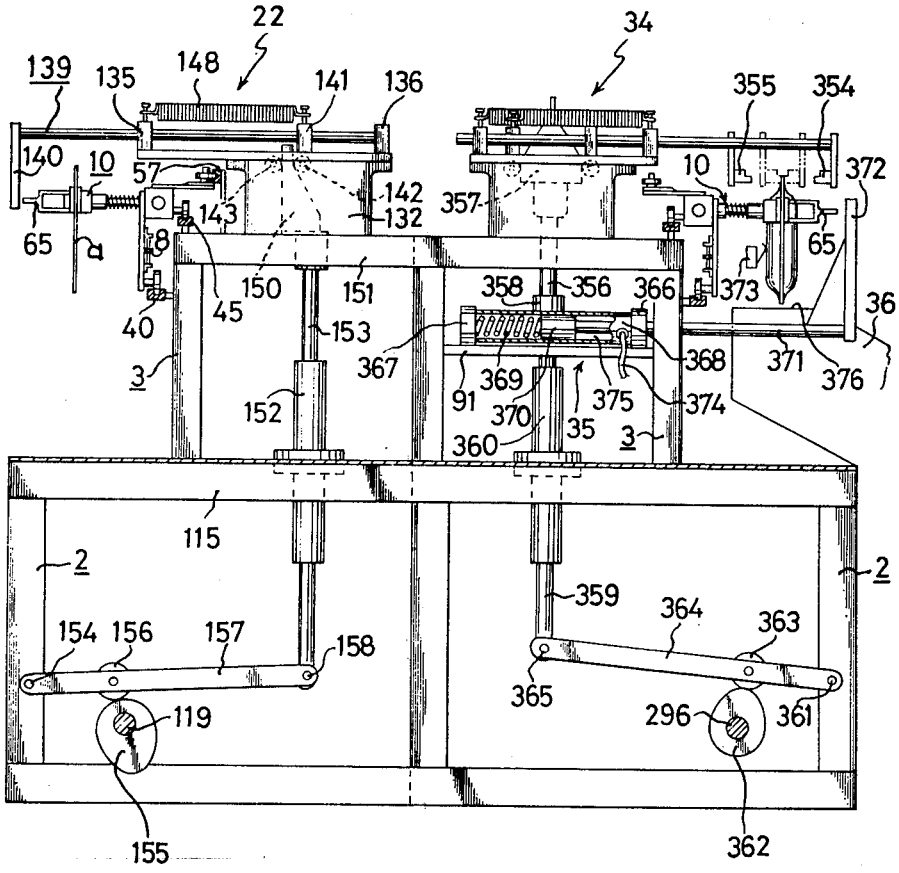
FIG. 10 is a schematic view of a part of the apparatus shown in FIG. 1.
Figure 11:
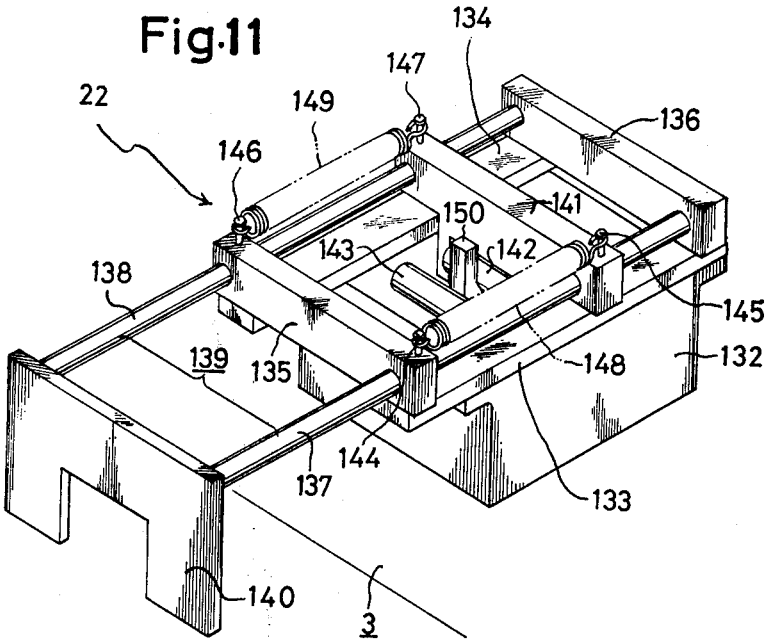
FIG. 11 is a schematic view of a gripper actuating device mounted at a first station.

As shown in FIGS. 9 through 11, each of the gripper actuating devices 22 is mounted on the platform 3 by means of a supporting block 132 on which a pair of plates 133 and 134 are fixed. The plates 133 and 134 extend in parallel to each other. A guide plates 135 and 136 are disposed on the plates 133 and 134 and extend transversely with respect to the plates 133 and 134. The guide plates 135 and 136 are formed with bores (nonumeral), respectively, in which actuating bars 137 and 138 are slidably received. The actuating bars 137 and 138 constitute a slider 139. An actuating or engaging plate 140 is connected to one end of each of the bars 137 and 138 and is engageable with actuating elements 65 and 66 forming part of the gripper 10 so that fork portions of the elements 65 and 66 urges the slidable sleeves 69 and 70 against the actions of the compression springs 81 and 82 away from the nuts 75 and 76 by which the pinching projections are spaced from each other to accommodate the side edge of the pouch. A cross bar 141 connected between actuating bars 137 and 138 and a tension spring 148 is mounted between the guide plate 135 and the cross bar 141 as at 144 and 145 while a tension spring 149 is mounted therebetween as at 146 and 147. The tension springs 148 and 149 serves to urge the bars 137 and 138 and accordingly the engaging plate 140 away from the actuating elements 65 and 66 so that the slidable sleeves 69 and 70 moved toward and abut against the nuts 75 and 76 by the actions of the compression spring 81 and 82. As best shown in FIGS. 10 and 11, a roller 142 is rotatably supported by the cross bar 141 and a roller 143, which extends in parallel to the roller 142, is rotatably supported by the supporting block 132 at an upper portion thereof. With this arrangement, the roller 142 mounted on the cross bar 141 is urged toward the roller 143 mounted on the supporting block 132 by the actions of the tension springs 148 and 149. The gripper actuating device 22 includes a cam plate 150 which is movable between rollers 142 and 143 and which is connected to a vertical shaft 153 slidably accommodated in a sleeve 152 supported by the base 2. The vertical shaft 153 is connected at its lower end with one end of a shifter lever 157 by means of a pivot pin 158. The shifter lever 157 is connected at its other end to the base 2 by means of a pivot pin 154 and carries at its intermediate portion a cam follower 156. The cam follower 156 is engageable with a cam 155 rotatably mounted on a drive shaft 119, which is arranged to be driven in relation to the intermittent circular movements of the endless transfer chain 8. As the cam 155 rotates the shifter lever 157 counterclockwise as viewed in FIG. 10, the vertical shaft 153 connected thereto is moved upward thereby causing the cam plate 150 to move the roller 142 away from the roller 143 so that the cross bar 141 is moved rightward as viewed in FIG. 10 against the actions of the tension springs 148 and 149. In this instance, the actuating or engaging plate 140 is brought into abutting engagement with the actuating elements of the gripper 10 for thereby opening the grippers 79 and 80 in a manner as previously mentioned. If, however, the shifter lever 157 is rotated clockwise by the action of the cam 155, then the vertical shaft 153 is moved downward so that the cam plate 150 is moved to a position in which the roller 142 is moved toward the roller 143. In this instance, the cross bar 141 is moved leftward by the actions of the tension springs 148 and 149 and, therefore, the engaging plate 140 is brought out of engagement with the actuating elements of the gripper 10 whereby the gripping members 79 and 80 are caused to grip the side edges of the retort pouch.

It should be noticed that the retort pouch supplying device is moved upward to feed the retort pouch to a position between the gripping members 79 and 80 when the cross bar 141 of the gripper actuating mechanism 22 is moved to a position to cause the actuating plate 140 to be disengaged from the actuating elements 65 and 66 of the gripper 10. Thus, the gripper actuating device 22 is actuated in synchronism with the operation of the gripper 10.

Figure 13:
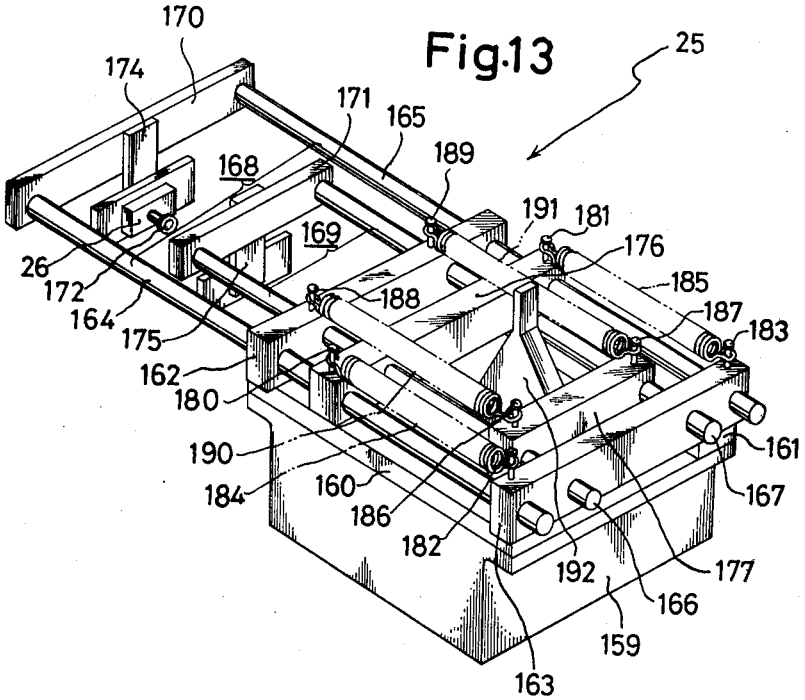
FIG. 13 is a perspective schematic view of the pouch opening device shown in FIG. 12.
Figure 12:
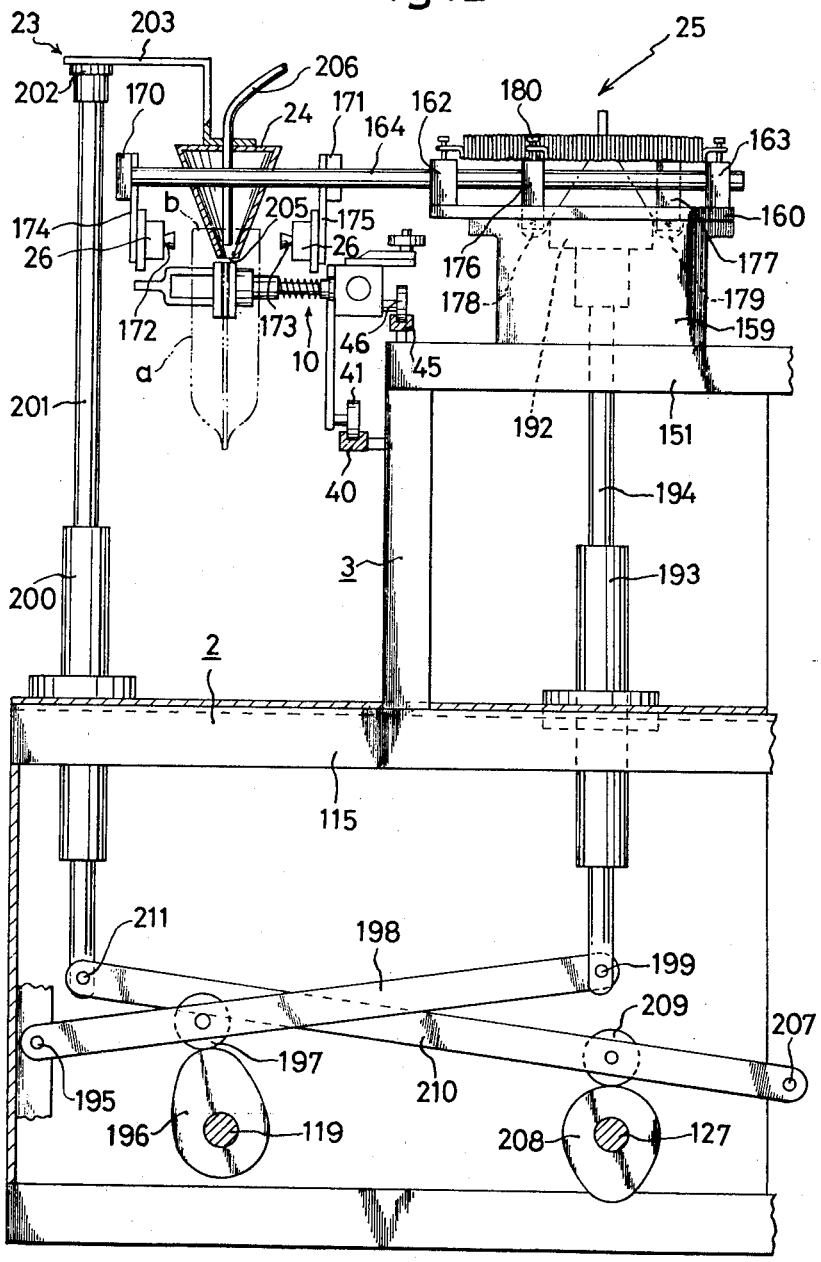
FIG. 12 is a schematic view of a pouch opening device and a pouch dilating device mounted at a second station of the apparatus.

As shown in FIGS. 12 and 13, each of the pouch opening devices 25 mounted at the second station 12 comprises a supporting block 159 mounted on the upper surface of the platform 3. A pair of plates 160 and 161 are disposed on the supporting block 159. A pair of laterally extending guide plates 162 and 163 are fixed on the plates 160 and 161. The guide plates 162 and 163 are formed with bores (no numeral) in which a pair of outer bars 164 and 165 and another pair of inner bars 166 and 167 are respectively slidably received. The outer bars 164 and 165 are connected at their one end to an end plate 170, to which a vertical plate 174 is fixedly connected. The vertical plate 174 carries thereon the vacuum suction member 26 having a vacuum cap 172 communicable with the suitable vacuum source. The inner bars 166 and 167 carries thereon at their one end an end plate 171, to which a vertical plate 175 is fixedly connected. The end plate 175 is provided with the vacuum suction member 26 including a vacuum cup 173 communicable with the suitable vacuum source. A cross bar 176 is connected to and movable with the outer bars 164 and 165, and a cross bar 177 is connected to the inner bars 166 and 167. Tension springs 184 and 185 are provided between the cross bar 176 and the guide plate 163. The tension spring 184 is conected at its one end to a pin 180 on the cross bar 176 and at the other end thereof to a pin 182 of the guide bar 163. Likewise, the tension spring 185 is connected at its one end to a pin 181 of the cross bar 176 and at the other end to a pin 183 of the guide bar 163. Thus, the outer bars 164 and 165 are urged rightward as viewed in FIG. 13 so that the end plate and accordingly the vacuum suction member 26 are urged toward one side of the retort pouch a. Similarly, a tension spring 190 is connected at its one end to a pin 88 of the guide plate 162 and at the other end thereof to a pin 186 of the cross bar 177. A tension spring 191 is connected at its one end to a pin 189 of the guide plate 162 and at the other end to a pin 187 of the cross bar 177. With this arrangement, the inner bars 166 and 167 and accordingly the end plate 171 connected thereto are urged leftward as viewed in FIG. 13 so that the vertical plate 175 and therefore the vacuum suction member 26 is urged toward another side of the retort pouch a.

As best shown in FIG. 12, rollers 178 and 179 are mounted at lower ends of the cross bars 176 and 177, respectively. A cam plate 192 is arranged to be movable between the rollers 178 and 179 by a vertical shaft 194 slidably received in a sleeve 193 mounted on the base 2. As the cam plate 192 is moved downward, the rollers 178 and 179 and accordingly the cross bars 176 and 177 are moved away from each other against the actions of the tension springs 190, 191, 184 and 185 so that the vacuum suction members 26 are moved away from each other and the vacuum cups 172 and 173 are away from each other while retracting the side walls of the pouch a by the action of the vacuum delivered to the cups 172 and 173. Thus, the pouch a is dilated in a manner as shown in FIG. 12 thereby providing an opening *b*. Threafter, the supply of vacuum to the cups 172 and 173 is interrupted and air under pressure is supplied through the opening b into the pouch a while a lower end of the air nozzle 24 is entered into the opening *b*. It should be noted that the cam plate 192 is arranged to be lowered when a pair of new retort pouches are transferred to the second station whereby the vacuum suction members 26 are moved toward each other.

The upward and downward movements of the cam plate 192 is controlled by the shaft 194 connected at its lower end to one end of a shifter lever 198. The shifter lever 198 is pivotally connected at its another end to the side wall (no numeral) of the base 2 and carries at its intermediate portion a cam follower 197. The cam follower 197 is held in engagement with a cam 196 rotatable with a cam shaft 119 which is driven in synchronism with the intermittent circular movements of the endless transfer chain 8.

As shown in FIGS. 3 and 12, the pouch dilating device 23 includes a vertical shaft 201 slidably received in a sleeve 200 connected to the upper frame 115 of the base 2. A horizontal member 202 is connected to top end of the vertical shaft 201 and supports the air nozzles 24 in the forms of conical casings in which air supply pipes 206 extend. The air nozzles 24 are connected to both ends of the horizontal member 202 by fasteners 203 and 204. The vertical shaft 201 is arranged to be lowered when the opening *b* is formed in each of the pouches a by the actions of the vacuum cups so that the air nozzles 24 having orifices 205 are entered into the openings *b* of the pouches a and thereafter the air under pressure is supplied through the orifices 205 into the pouches a from a suitable source of air under pressure thereby dilating the pouches *a*, and raised toward its original position after the pouches have been completely dilated.

In FIG. 12, the vertical shaft 201 is connected at its lower end to a shifter lever 210 by means of a pivot pin 211. The shifter lever 210 is connected at its other end to a pivot pin 207 mounted on the base 2 and carries thereon a cam follower 209. The cam follower 209 is held in engagement with a cam 208 rotatable with a cam shaft 127, which is driven in synchronism with the intermittent movements of the transfer chain 8.

Figure 14:
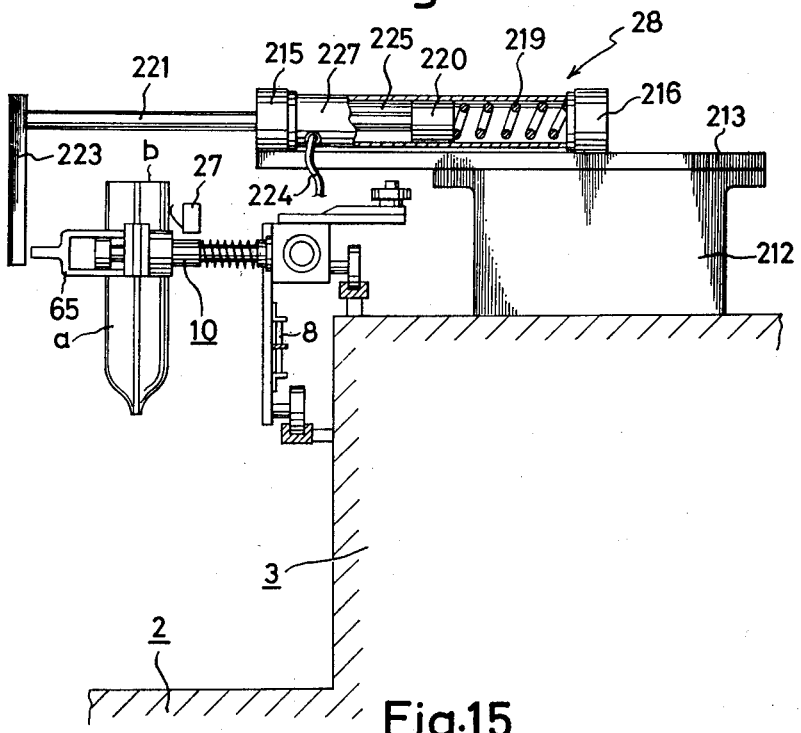
FIG. 14 is a plan view partly in cross section illustrating a gripper releasing device of the apparatus shown in FIG. 1.
Figure 15:
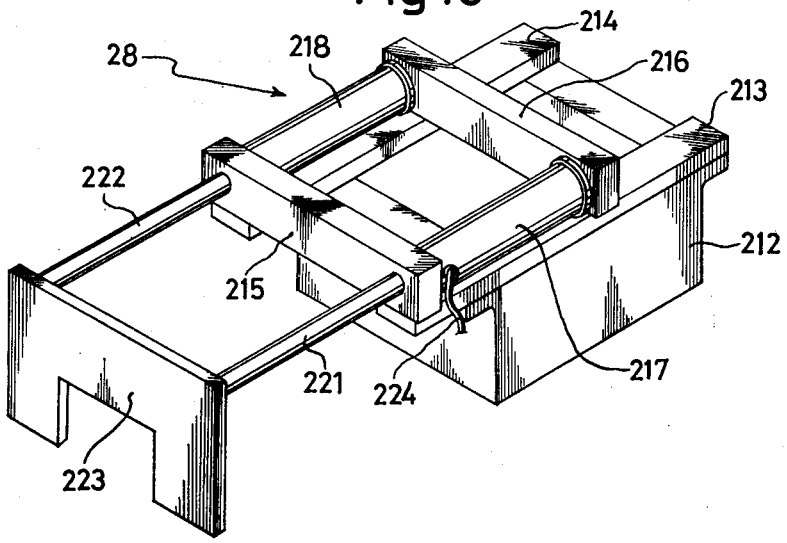
FIG. 15 is a perspective view of the gripper releasing device of FIG. 14.

As shown in FIGS. 14 and 15, each of the gripper releasing devices 28 mounted on the third station 13 includes a supporting block 212 mounted on the upper surface of the platform 3. A pair of mounting plates 213 and 214 are fixed to the upper surface of the block 212 for mounting stationary cross bars 215 and 216 in spaced relationship, between which a pair of actuating means such as cylinders 217 and 218 are disposed. s shown in FIG. 14, a piston 220 is slidably accommodated in a cylinder or fluid chamber 225 of the cylinder and urged by a compression spring 219 leftward as viewed in FIG. 14. The slidable pistons of the cylinders 217 and 218 wre operatively connected to piston rods 221 and 222, respectively, to which an engaging plate 223 is fixedly connected. The engaging plate 223 extends vertically as shown in FIG. 14 so that the lower end of the plate 223 assumes a position facing the end of the actuating elements of the gripper 10. The cylinder assembly thus constructed is connected to a suitable source of fluid under pressure so that the fluid chamber is supplied with fluid under pressure at selected time instants as will be described in detail. Selective supply of fluid under pressure into the fluid chamber of the cylinder is achieved by a suitable valve means such as a solenoid valve which is disposed in a fluid circuit between the fluid chamber of the cylinder and the source of fluid under pressure. The solenoid valve is electrically connected to a suitable sensing means such as a microswitch 27 and controlled thereby. Each of the microswitch 27 is located at a position near the travelling path of the transfer chain 8 to sense defective opening b of the retort pouch a for thereby generating an actuating signal indicative thereof. The solenoid valve is responsive to this actuating signal and permit the fluid under pressure to pass into the fluid chamber 225 of the cylinder so that the piston 220 is moved rightward against the action of the compression spring 219. In this instance, the piston rod and accordingly the engaging plate 223 is moved rightward thereby moving the actuating elements of the gripper 10 to release the retort pouches a. When the retort pouches a are released from the grippers 10, then the microswitches 27 deenergize the solenoid valves so that the fluid under pressure is not supplied into the fluid chambers of the cylinders 217 and 218. Under these circumstances, the pistons 220 are moved leftward by the actions of the compression springs 219 to their original positions.

As shown in FIGS. 1 and 3, the solid material throwing or supplying device 29 mounted at the fourth station 14 comprises a vertical shaft 227 slidably disposed in a sleeve 226 supported by the upper frame 115 of the base 2 at the fourth station 14. The vertical shaft 227 is provided at its upper end with an annular member 228 fixedly connected thereto. The annular member 228 is formed with a pair of transversely extending mounting arms 229 and 230, by which hoppers 231 and 232 are respectively supported so as to be located above the grippers 10. The solid material supplying device 29 also includes a sensing means such as a microswitch 233 which is disposed on a travelling path Y of the retort pouch and generates an electric signal when the pouch reaches a position below the outlet 234 of the hopper. In this instance, the vertical shaft 227 is moved downward so that the outlet of the hopper is entered into the opening *b* of the retort pouch. Thereafter, a valve mechanism (not shown) mounted at the outlet portion of the hopper is actuated to open the outlet in response to the electric signal from the sensing means 233, whereby the solid material is fed into the pouch *a*. The solid material supplying device 29 is arranged such that the hoppers will be raised to their original positions after the solid material has been supplied into the retort pouches. To this end, the vertical shaft 227 is connected at its lower end to a shifter lever 239 by means of a pivot pin 240. The shifter lever 239 is connected at its one end to the vertical frame (no numeral) of the base 2 by means of a pivot pin 235. This lever 239 carries at its intermediate portion a cam follower 238 which is in engagement with a cam 237 rotatable with a cam shaft 236, which is rotated in synchronism with the intermittent circular movements of the transfer chain 8.

Figure 16:
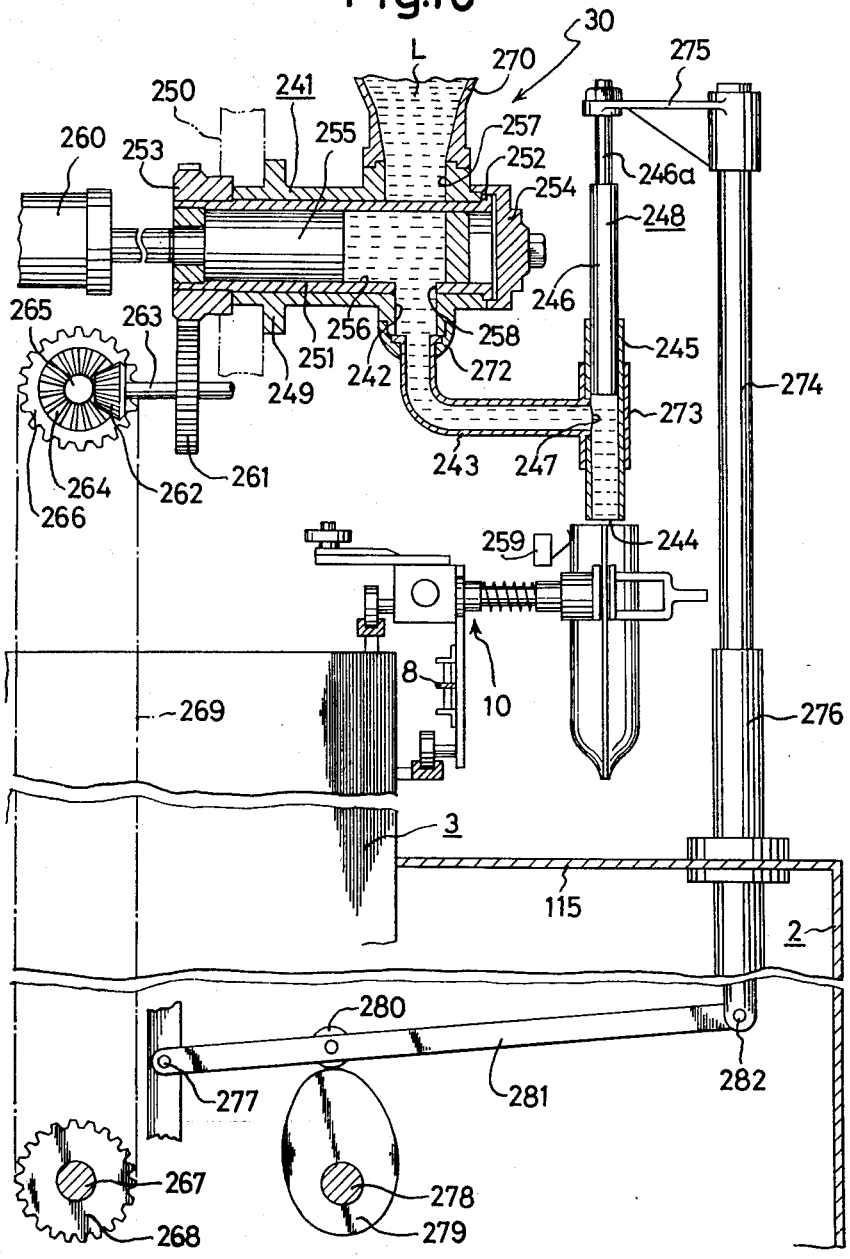
FIG. 16 is a schematic view partly in cross section showing a viscous liquid supplying device.
Figure 17:
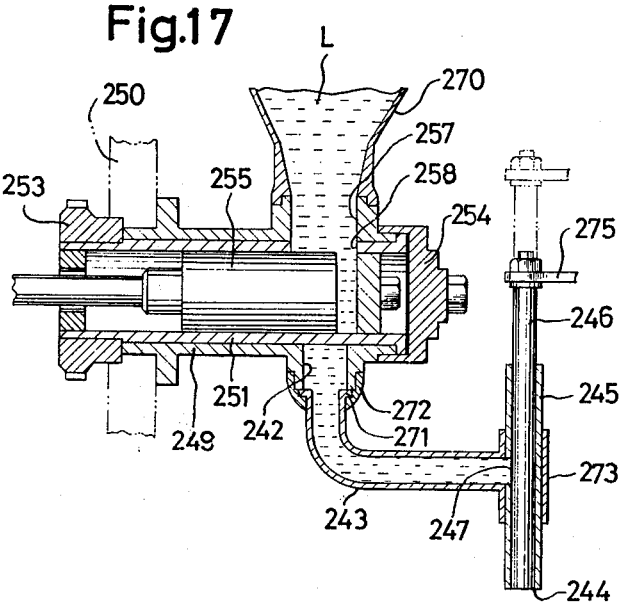
FIG. 17 is a view illustrating the mode of the device shown in FIG. 16.

As shown in FIGS. 16 and 17, each of the viscous liquid filling devices 30 mounted at the fifth station 15 includes a viscous liquid filling body 241, which is arranged to feed a predetermined amount of viscous liquid such as curry powder and wheat flour in liquid form into the retort pouch in which the solid materials such as carrot, potato, onion and meat or the like have been stowed. The viscous liquid filling body 241 has an outlet 242, with which a liquid delivering pipe 243 communicates. The liquid delivering pipe 243 communicates through an opening 247 with a nozzle cylinder 245. The nozzle cylinder 245 extends vertically toward the gripper 10 so that the outlet 244 of the nozzle cylinder 245 is located directly above the opening *b* of the retort pouch a as shown in FIG. 16. A piston 247 is slidably received in the nozzle cylinder 245 and is connected to a piston rod 246a, which is connected to and supported by a plate 275 fixed to a vertically slaidable shaft 274. The shaft 274 is slidably disposed in a sleeve 276 fixed to the upper frame 115 of the base 2 and connected at its lower end to one end of a shifter lever 281 by means of a pivot pin 282. The shifter lever 281 is connected at the other end thereof to the vertical frame (no numeral) of the base 2 by means of a pivot pin 277 and carries thereon a cam follower 280. This cam follower 280 is held in engagement with a cam 279 rotatable with a cam shaft 278, which is rotated in synchronism with the intermittent circular movements of the endless transfer chain 8.

Turning now back to the viscous liquid filling body 241, a pump body 249 is provided which is connected to a gear box 250 shown by a phantom line in FIG. 16, with the gear box 250 being mounted on the platform 3. A rotary cylinder valve 251 is rotatably disposed in the pump body 249. The rotary cylinder valve 251 is formed at its one end with an annular flange 252 engaging with an annular shoulder (no numeral) of the body 249 and connected at the other end thereof to a driven gear 253 disposed within the gear box 250. Thus, the axial movements of the rotary cylinder valve 251 are limited by the annular flange 252 and the driven gear 253. Indicated at 254 is a cylinder cap which is disposed on the annular flange of the cylinder valve 251 to close the end of the cylinder valve 251. The cylinder valve 251 is formed with a valve opening 258, which, when the valve cylinder 251 is rotated to a position shown in FIG. 16, is aligned with the outlet 242 of the body 241 so that the viscous liquid is supplied into the pipe 243. A piston 255 is slidably disposed in the cylinder valve 251 defining a cylinder chamber 256, into which viscous liquid is selectively admitted from a suitable source of viscous liquid in a manner as will be subsequently described in detail. The piston 255 is connected to and actuated by a suitable actuating means such as a fluid cylinder 260. The fluid cylinder 260 is of any known construction and controlled by a solenoid valve which is electrically connected to and controlled by a sensing means such as a microswitch 259. The microswitch 259 is located at a suitable position near the travelling path Y of the retort pouches a and generates an electric signal when it senses the retort pouch being fed to the fifth station 15. If the electric signal is generated, then the solenoid valve (not shown) is energized to supply fluid under pressure into the cylinder 260, which is consequently actuated to move the piston 255 rightward as viewed in FIG. 16 and thus the viscous liquid in the cylinder chamber 256 is delivered under pressure through the valve opening 258 and the outlet 242 into the pipe 243 through which the liquid is delivered into the nozzle cylinder 245.

The driven gear 253 rotatable with the cylinder valve 251 is in mesh with a gear 261, which is connected to a rotatable shaft 263. The shaft 263 is connected to a pinion gear 262 meshing with a bevel gear 264. The bevel gear 264 is connected to and rotatable with a shaft 265 to which a sprocket 266 is fixedly connected. The sprocket 266 is driven by a driving sprocket 268 by means of an endless means 269. The driving sprocket 268 is connected to and rotatable with a shaft 267 which is driven by a suitable driving source in synchronism with the intermittent circular movements of the transfer chain 8.

Figure 18:
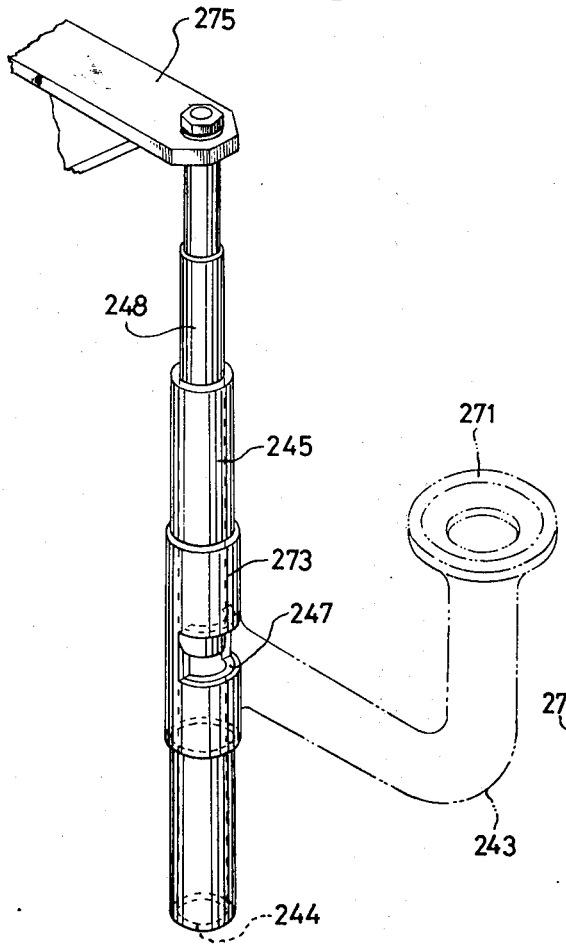
FIGS. 18 and 19 are enlarged views of a part of the viscous liquid supplying device.
Figure 19:
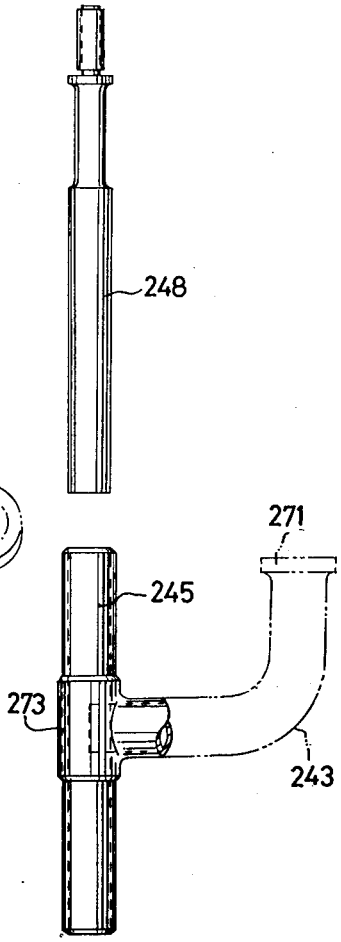

The body 249 is formed with an inlet 257, to which a hopper 270 filled with a viscous liquid L is connected. As the rotary cylinder valve 251 is rotated to assume a position shown in FIG. 17, the valve opening 258 of the cylinder valve 251 is brought into communication with the inlet 257 of the body 249 so that the viscous fluid is supplied into the cylinder chamber 256. As shown in FIGS. 18 and 19, the viscous liquid delivering pipe 243 has a top end 271 which is connected to the outlet 242 of the body 249 by a nut 272. The pipe 243 formed at its lower end with a holding member 273, by which the nozzle cylinder 245 is supported. It will be noted that the supply of the viscous liquid into the retort pouch a is effected by rightward movement of the piston 255 and is interrupted by moving the piston 246 downward thereby to close the opening 247. It will be noticed that the viscous liquid in the nozzle cylinder 245 is completely fed into the retort pouch and thus the drippings of the liquid are prevented.

Figure 20:
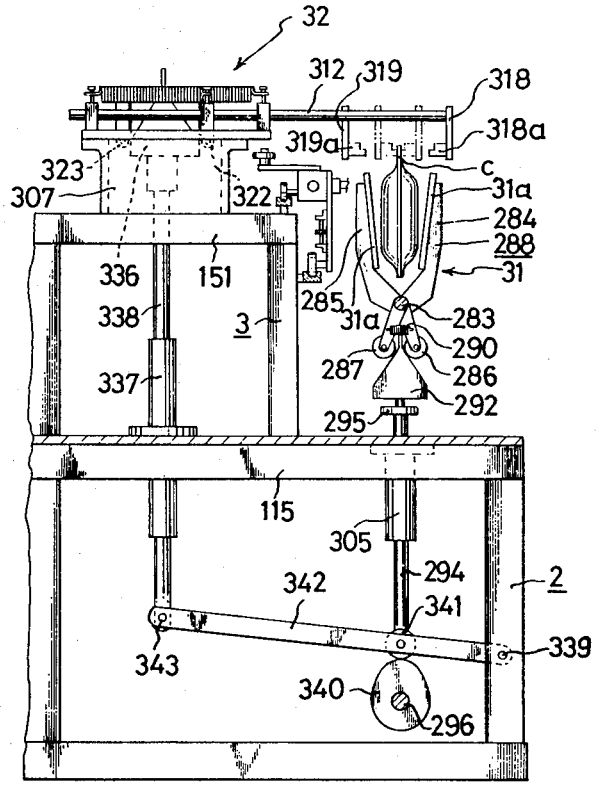
FIG. 20 is a schematic view of a deflating device and a sealing device of the apparatus shown in FIG. 1.
Figure 21:
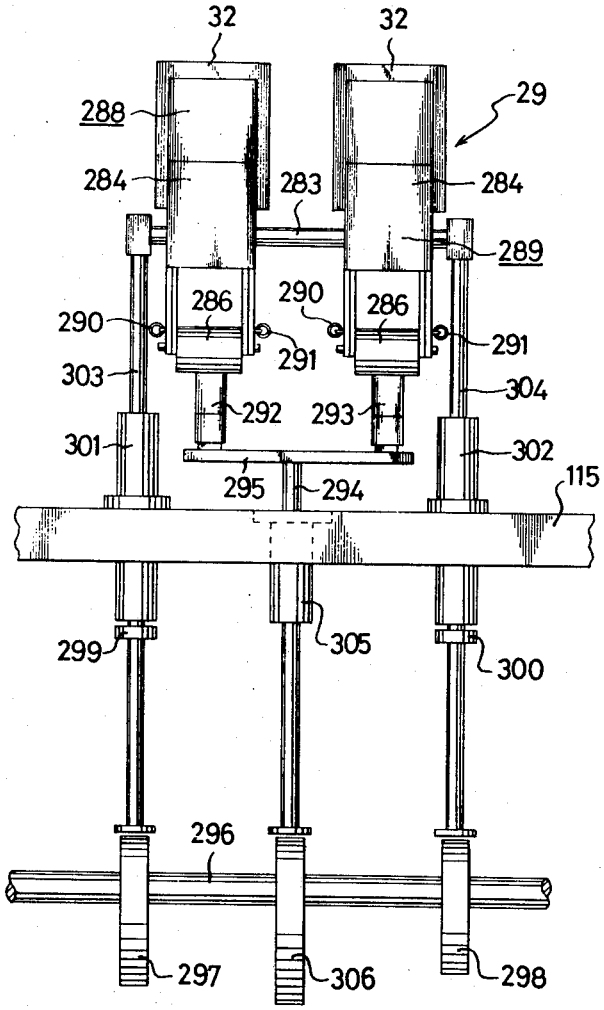
FIG. 21 is an enlarged schematic view of the deflating device shown in FIG. 20.

As shown in FIGS. 20 and 21, each of the deflating devices 31 mounted at the sixth station 16 includes a pair of arms 284 and 285 having pressure plates 32 respectively. The pair of arms 284 and 285 are pivotally supported by a common pivot shaft 283 and urged toward each other by a tension spring 290 provided between the lower ends of the arms 284 and 285. Rollers 286 and 287 are provided at lower ends of the arms 284 and 285, respectively. Cam plates 292 and 293 are arranged to cooperate with pairs of rollers 286 and 287, respectively, as shown in FIG. 21. These cam plates 292 and 293 are supported by a plate 295, which is raised and lowered by a vertical shaft 294 slidably disposed in a sleeve 305 fixed to the upper frame 115 of the base 2. The vertical shaft 294 is held at its bottom end in engagement with a cam 306 rotatable with a common cam shaft 296 which is driven in synchronism with the intermittent circular movements of the endless transfer chain 8. The common shaft 283 is connected at its opposite ends to vertical shafts 303 and 304, which are slidably disposed in guide sleeves 301 and 302 fixed to the upper frame 115 of the base 2. The shafts 303 and 304 are formed with stoppers 299 and 300 at intermediate portions thereof respectively. The stoppers 299 and 300 are adapted to be engageable with bottom ends of the guide sleeves 301 and 302 thereby limiting upper strokes of the respective shafts. The shafts 303 and 304 are held at their lowermost ends in engagement with cams 297 and 298 rotatable with the common cam shaft 296 with which ahe cam 306 for the vertical shaft 294 is also rotatably connected. With the arrangement mentioned hereinabove, when a pair of retort pouches a are moved to the sixth station 16, the units 288 and 289 are raised by the vertical shafts 303 and 304 engaging with the cams 297 and 298. At the same time, the cam plates 292 and 293 are moved upward by the shaft 294 engaging with the cam 306, thereby moving the rollers 286 and 287 of the respective units 288 and 289 away from each other against the action of the tension spring 290 whereby the pair of pressure plates 32 are moved toward each other and thus the retort pouch is deflated to release air therefrom After the remaining air is released from each of the retort pouches *a*, the upper edge of each of the retort pouches is sealed by each of the sealing devices 32 mounted at the sixth station 16.

Figure 22:
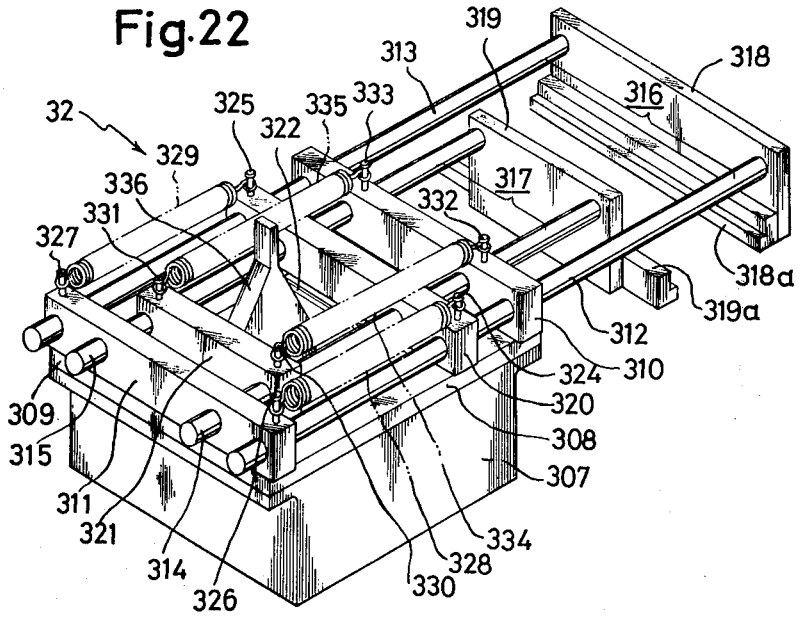
FIG. 22 is a schematic perspective view of the sealing device shown in FIG. 20.

As shown in FIGS. 20 and 22, the sealing device 32 mounted at the sixth station 16 includes a supporting block 307 mounted on the platform 3. A pair of plates 308 and 309 are disposed on the supporting block 307 and extend transversely with respect to the travelling path Y of the pouches. A pair of guide plates 310 and 311 are fixedly disposed on the plates 308 and 309 and extend laterally with respect thereto. The guide plates 310 and 311 are formed with bores through which slidable shafts 312 and 313 extend in a plane perpendicular to the travelling path Y of the retort pouch. A pair of slidable shafts 314 and 315 also extends through bores formed in the guide plates 310 and 311 in parallel to the slidable shafts 312 and 313. The slidable shafts 312 and 313 will be referred to as an outer slider 316, while the slidable shafts 314 and 315 will be referred to as an inner slider 317. The outer slider 316 is provided at its rightmost end with a vertical plate 318, on which a heating or sealing bar 318*a* is mounted. Likewise, the inner slider 317 is provided at its rightmost end with a vertical plate 319, on which a heating or sealing bar 319*a* is mounted. As best shown in FIG. 22, a cross bar 320 is fixed to and movable with the inner shafts 314 and 315 and outer shafts 312 and 313 between the guide plates 310 and 311. Similarly, a cross bar 321 is fixed to and movable with the inner shafts 314 and 315 between the guide plate 311 and the cross bar 320. A pair of tension springs 328 and 329 are operatively mounted between the guide plate 311 and the cross bar 320 by pins 324 and 326 and by pins 325 and 327, respectively, so that the vertical plate 318 and sealing bar 318a mounted thereon are urged toward one side of the retort pouch. Similarly, a pair of tension springs 334 and 335 are operatively mounted between the guide plate 310 and the cross bar 321 by pins 330 and 332 and by pins 331 and 333, respectively, so that the vertical plate 319 and accordingly the sealing bar 319*a* are urged toward another side of the retort pouch. As best shown in FIG. 20, rollers 322 and 323 are rotatably mounted at the bottom walls of the cross bars 320 and 321, respectively. The sealing device also includes a cam plate 336, which is disposed between the rollers 322 and 323. The cam plate 336 is connected to an upper end of a vertical shaft 338 slidably disposed in a guide sleeve 337 fixed to the upper frame 115 of the base 2. The vertical shaft 338 is connected at its lower end to a shifter lever 342 by means of a pivot pin 343. The shifter lever 342 is connected at the other end thereof to the vertical frame (no numeral) of the base 2 by means of a pivot pin 339. The shifter lever 342 carries a cam follower 341, which is in engagement with a cam 340 rotatable with the cam shaft 296 which has been already discussed hereinabove. With the arrangement mentioned above, if the cam plate 336 is held in a position to maintain the rollers 322 and 323 away from each other, the slidable shafts 312 and 313 and accordingly the sealing bar 318a are held in a position away from the one side of the retort pouch while the slidable shafts 314 and 315 and accordingly the sealing bar 319 are held in a position away from another side of the retort pouch. If, however, the cam plate 336 is lowered, the rollers 322 and 323 are moved toward each other by the actions of the tension springs 328, 329, 334 and 335 so that the sealing bars 318*a* and 319*a* abut against respective sides of the retort pouch and, thus, the upper edge portion of the retort pouch is sealed as shown in FIG. 20.

Figure 23:
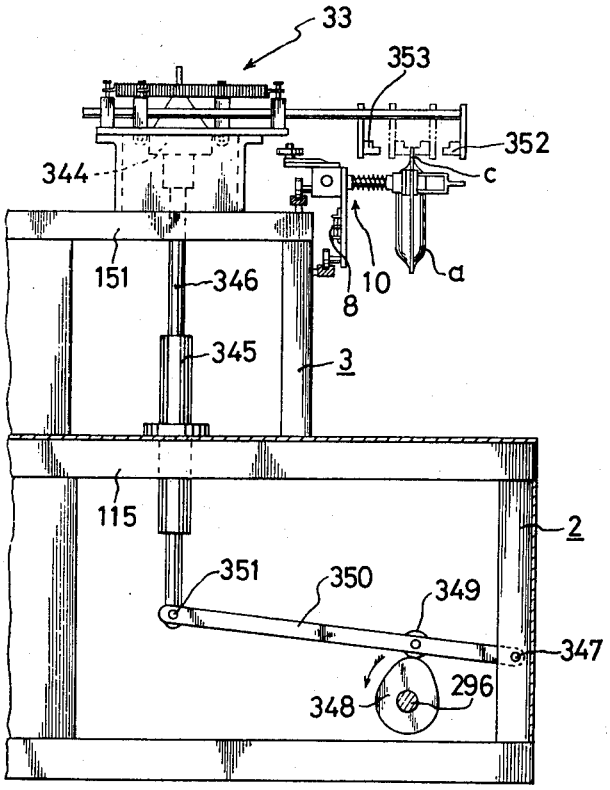
FIG. 23 is a schematic view of a sealing device mounted on a seventh station of the apparatus.

As shown in FIG. 23, each of the sealing device 33 mounted at the seventh station 17 is arranged to be similar in construction as the sealing device 32 of the sixth station 16 and, therefore, a detail description of the same is herein omitted for the sake of simplicity of description. A cam plate 344 forming part of the sealing device 33 is connected to an upper end of a vertical shaft 346 slidably disposed in a guide sleeve 345 fixed to the upper frame 115 of the base 2. The vertical shaft 346 is connected at its lower end to one end of a shifter lever 350 by means of a pivot pin 351. The shifter lever 350 is connected at the other end thereof to the vertical frame of the base by a pivot pin 347. The shifter lever 350 carries thereon a cam follower 349 which is in engagement with a cam 348 rotatable with the cam shaft 296 which has been previously described. The sealing device 33 has a pair of sealing bars 352 and 353, which are intended to seal again the sealing portion c of the retort pouch after the sealing operation of the sealing device 32 so that the upper edge of the retort pouch is completely sealed.

It will be understood that the sealing bars 318a and 319a and the sealing bars 352 and 353 of the sealing devices 32 and 33 are heated to a high temperature during sealing operation.

As shown in FIG. 10, each of the sealing devices 34 mounted at the eighth station 18 are constructed and arranged to be similar in construction as the sealing device 32 except that cooling bars 354 and 355 are provided to cool the sealed edge portion of the retort pouch. The sealing devices 34 include cam plates 357 which are supported by vertical rods 356 mounted on a horizontal plate 358. The horizontal plate 358 is connected to a vertical shaft 359 slidably disposed in a guide sleeve 360 fixed to the upper frame 115 of the base 2. The vertical shaft 359 is connected at its lower end to one end of a shifter lever 364 by means of a pivot pin 365. The shifter lever 364 is connected at the other end thereof to the vertical frame (no numeral) of the base 2 by means of a pivot pin 361. The shifter lever 364 carries thereon a cam follower 363 which is in engagement with a cam 362 rotatable with the cam shaft 296. The sealing devices 34 are arranged such that when the retort pouches are fed to the eighth station by the grippers 10 the cam plates 357 are lowered to cause the cooling bars 354 and 355 to move toward each other to press opposite sides of respective pouches for thereby cooling the sealed portion c of the each of the pouches. After a certain interval, the cam plates 357 are raised to cause the cooling bars 354 and 355 to move away from each other.

Each of the gripper releasing devices 35 includes a cylinder 368 disposed between cylinder heads 366 and 367 fixedly mounted on a supporting plate 91 provided in the platform 3. A piston 370 is slidably accommodated in the cylinder 368 and has a piston rod 371 connected thereto. The piston rod 371 is connected at its rightmost end to a gripper releasing plate 372 which is adapted to be engageable with the actuating elements of the grippers 10 for thereby releasing the grippers 10. The piston 370 is usually urged by a compression spring 369 disposed in a cylinder chamber 375 so that the actuating plate 372 is moved away from the actuating elements 65. The cylinder chamber 375 is connected to a suitable source of fluid under pressure through a suitable valve means such as a solenoid (not shown). The solenoid is connected to and controlled by a sensing means such as a microswitch 373, which is arranged to generate an electric signal when it senses the retort pouch. The solenoid valve is responsive to this electric signal generated by the sensing means 373 and establish fluid communication between the cylinder chamber 375 and the source of fluid under pressure so that the pressurized fluid is introduced into the cylinder chamber 375 and the piston 370 is moved against the action of the compression spring 369 in a direction to cause the actuating plate 372 to engage with the actuating elements 65 of the grippers 10 to cause the same to release the retort pouches. The retort pouches released from the grippers 10 are delivered through a passage 36 having a leading end 376 opened at a position below the grippers 10 to some suitable transfer means such as conveyor belts (not shown).

Figure 24:
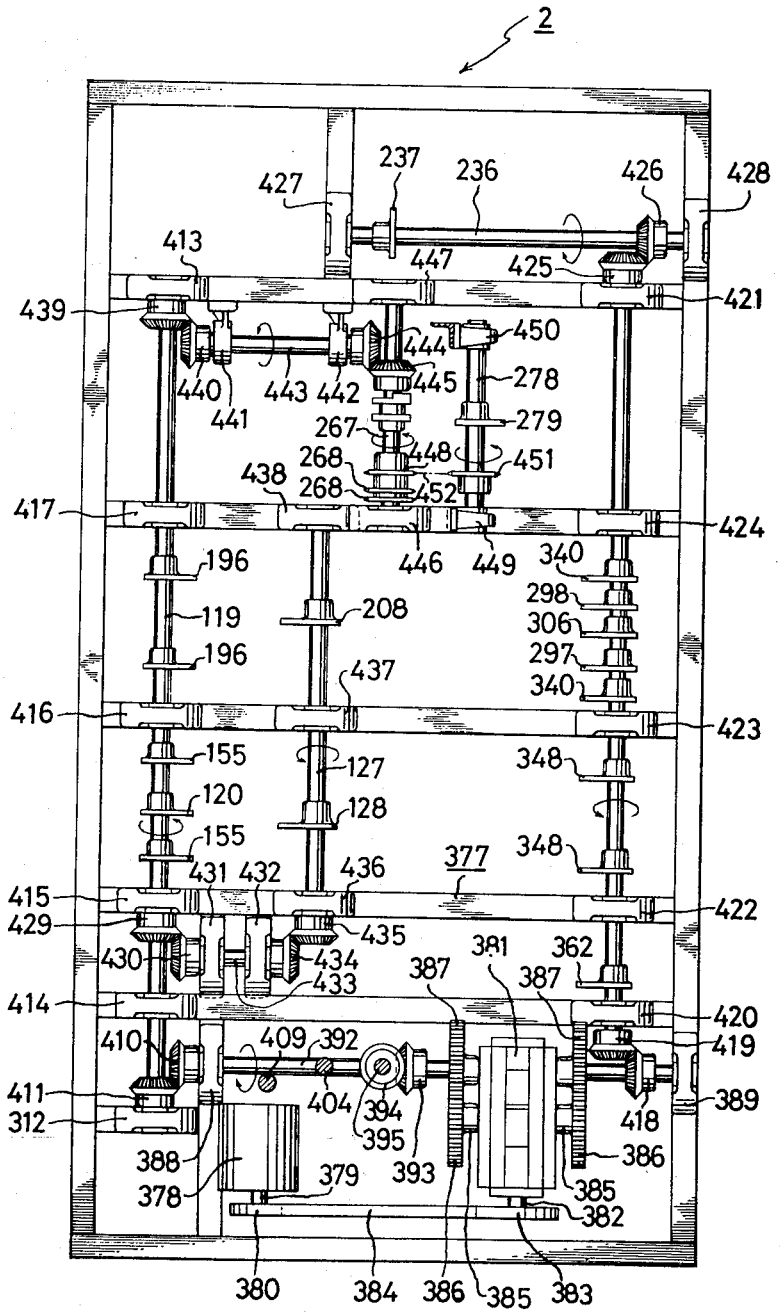
FIG. 24 is a schematic view of a control mechanism for the apparatus shown in FIG. 1.
Figure 25:
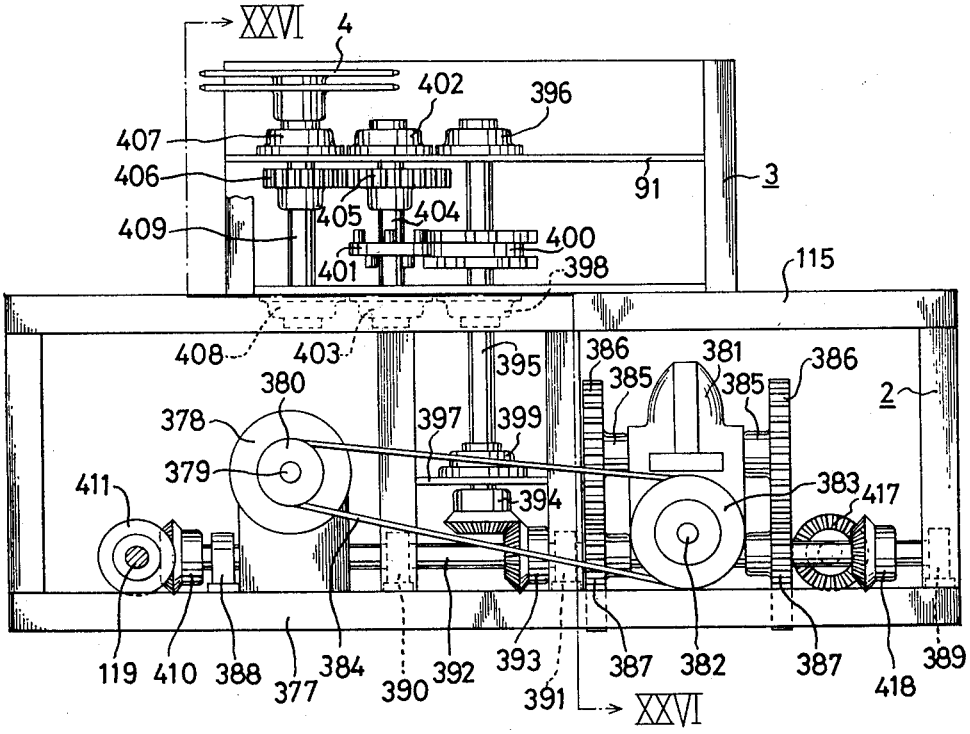
FIGS. 25 and 26 are schematic views of a part of the mechanism shown in FIG. 24.
Figure 26:
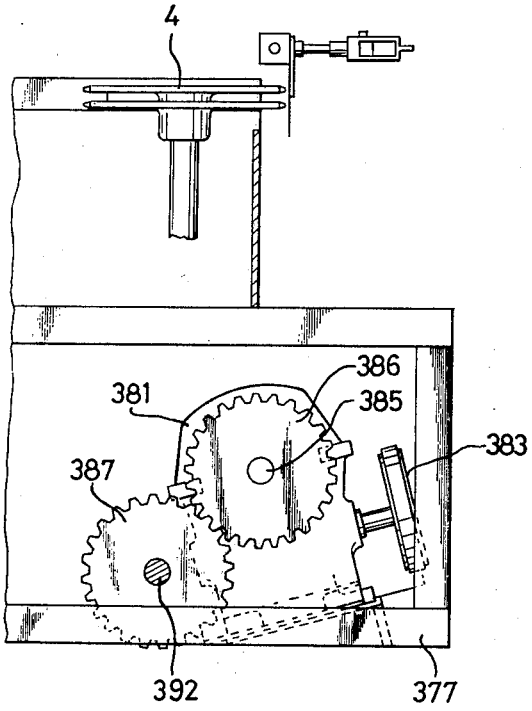

FIGS. 24 and 25 illustrate a preferred example of drive lines for the driving sprocket 4 to intermittently move the endless transfer chain 8 and for the cam shafts to rotate the cams in synchronism with the intermittent movement of the transfer chain 8. As shown, the drive line for the driving sprocket 4 is comprised of a suitable driving source such as a prime mover 378, which is mounted on a lower frame 377 of the base 2. The prime mover 378 has an output shaft 379, to which a pulley 380 is fixed. The output power from the prime mover 378 is transmitted through the pulley 380 and an endless belt 384 to a pulley 383 connected to and rotatable with an input shaft 382 of a power transmission 381. The power transmission 381 has output shafts 385, to which spur gears 386 are rotatably connected. The spur gears 386 are in mesh with spur gears 387 which are rotatable with a main shaft 392 journalled in bearings 388, 389, 390 and 391 mounted on a lower frame 377 of the base 2. The main shaft 392 carries thereon the spur gears 387 meshing with the spur gears 386 connected to the power transmission output shafts 385 and receives a power output therefrom. A bevel gear 393 is fixed to and rotatable with the main shaft 392. A bevel gear 394 is carried at a lower end of a vertical shaft 395 and meshes with the bevel gear 393. The vertical shaft 395 is rotatably supported by bearings 396 and 398 mounted on an intermediate frame 91 of the platform 3 and the upper frame 115 of the base 2, respectively. The vertical shaft 395 carries at its intermediate portion a geneva wheel 400, with which a pin wheel 401 engages to provide intermittent motion. The pin wheel 401 is rotatably supported by a vertical shaft 404 which is journalled on bearings 402 and 403 mounted on the intermediate frame 91 of the platform 3 and the upper frame 115 of the base 2. The vertical shaft 404 also carries thereon a spur gear 405 meshing with a spur gear 406 rotatably supported on a vertical shaft 409. The vertical shaft 409 is journalled on bearings 407 and 408 mounted on the intermediate frame 91 of the platform 3 and the upper frame 115 of the base 2, respectively. As best shown in FIG. 25, the vertical shaft 409 is connected at its upper end to the driving sprocket 4 for the endless transfer chain 8.

The drive line for the cam shafts is schematically illustrated in FIG. 24. As shown, the main shaft 392 is connected at its leftmost end to a bevel gear 410 meshing with a bevel gear 411 rotatable with the cam shaft 119. The cam shaft 119 is rotatably supported by bearings 413, 414, 415, 416 and 417 mounted on the lower frame 377 of the base 2. Thus, the cam shaft 119 extends in a direction perpendicular to the main shaft 392. Similarly, the main shaft 392 is connected at its rightmost end with a bevel gear 418, with which a bevel gear 419 rotatable with the cam shaft 296 meshes so that the cam shaft 296 extends in a direction perpendicular to the main shaft 392. The cam shaft 296 is rotatably supported by bearings 420, 421, 422, 423 and 424 mounted on the lower frame 377 of the base 2. The cam shaft 296 is connected at its output end to a bevel gear 425 meshing with a bevel gear 426 rotatable with the cam shaft 236 which extends in a direction perpendicular to the cam shaft 296 and is rotatably supported by bearings 427 and 428 mounted on the lower frame 377 of the base 2. On the other hand, a bevel gear 429 is fixed to and rotatable with the cam shaft 119 and meshes with a bevel gear 430 rotatably connected to an intermediate shaft 433. The intermediate shaft 433 is rotatably supported by bearings 431 and 432 and carries at its rightmost end a bevel gear 434 with which a bevel gear 435 meshes. The bevel gear 435 is mounted at the lower end of the cam shaft 127. The cam shaft 127 extends in a direction parallel to the cam shaft 119 and rotatably supported by bearings 436, 437 and 438 mounted on the lower frame 377 of the base 2. A bevel gear 439 is mounted to an output end of the cam shaft 119 and meshes with a bevel gear 440 mounted to one end of an intermediate shaft 443. The intermediate shaft 443 is rotatably supported by bearings 441 and 442 and carries at its another end a bevel gear 444 meshing with a bevel gear 445. The bevel gear 445 is rotatable with the shaft 267 which is journalled on bearings 446 and 447 mounted on the lower frame 377 of the base 2. A sprocket 448 is fixed to and rotatable with the shaft 267 and operatively connected to a sprocket 451 by means of a chain 452. The sprocket 451 is fixed to the shaft 278 which is rotatably supported by bearings 450 and 449. With the drive line mentioned above, the pair of cams 155 and other can 120 for the first station 11 are fixed to and rotatable with the cam shaft 119 between the bearings 415 and 416. Further, the cam 128 for the first station 11 is fixed to and rotatable with the cam shaft 127 at positions between the bearings 436 and 437. The pair of cams 196 for the second station 12 are fixed to and rotatable with the cam shaft 119 at positions between the bearings 416 and 417. Further, the cam 208 for the second station 12 is fixed to and rotatable with the cam shaft 127 at a position between the bearings 437 and 438. The cam shaft 236, which extends in a direction perpendicular to the cam shafts 119 and 127, is located in the area of the fourth station 14 and carries thereon the cam 237. The cam shafts 267 and 278, which extend in a direction parallel to the cam shafts 119 and 127, are located in the area of the fifth station 15. The cam shaft 267 carries thereon the driving sprockets 268, while the cam shaft 278 carries thereon the cam 279. The cam shaft 296 extends in parallel to the cam shaft 119 in the areas of the sixth, seventh and eighth stations 16, 17 and 18. The pair of cams 340, and other cams 297, 298 and 306 for the sixth station 16 are fixed to and rotatable with the cam shaft 296 at positions between the bearings 423 and 424. The pair of cams 348 for the seventh station 17 are fixed to and rotatable with the cam shaft 296 at positions between the bearings 422 and 423. The cam 362 for the eighth station 18 is fixed to and rotatable with the cam shaft 296 at a position between the bearings 420 and 422.

The operation of the apparatus according to the present invention will now be described hereinafter in detail with reference to FIGS. 1 through 26 and FIG. 27 in which each step of the process of the present invention is shown. When the prime mover 378 is started, the output power of the prime mover 378 is transmitted through the pulley 380 and the chain 384 to the pulley 383, from which the power is transmitted through the input shaft 382 to the power transmission 381. The output power transmitted to the power transmission 381 is then delivered to the output shafts 385 thereof at reduced gear reduction ratio to provide a desired revolution speed. The output power is then transmitted through the spur gears 386 and 387 to the main shaft 392, from which the power output is transmitted through the bevel gears 393 and 394 to the vertical shaft 395. Since the geneva wheel 400 and pin wheel 401 are provided on the vertical shafts 395 and 404, respectively, the continuous revolution is converted to an intermittent motion, which is transferred through the spur gears 405 and 406 and the shaft 409 to the driving sprocket 4. Thus, the endless transfer chain 8 is intermittently driven at a constant speed. On the other hand, the power output transmitted to the main shaft 392 is delivered to the cam shafts 119 and 296 through the bevel gears 410 and 411 and the bevel gears 417 and 418, respectively, so that the cam shafts 119 and 296 are continuously rotated at a given speed. The rotation of the cam shaft 119 will also cause the cam shafts 127, 267 and 278 to rotate at the same speed, while the rotation of the cam shaft 296 will cause the cam shaft 236 to rotate at the same speed. It will thus be noted that the endless transfer chain 8 is intermittently moved at a given speed whereas the cam shafts 119, 127, 236, 278 and 296 are rotated continuously at the speed synchronous with the intermittent movement of the transfer chain 8. It should be appreciated in this instance that the cam shafts and accordingly a group of cams mentioned hereinabove complete one rotation during the time in which the transfer chain 8 is moved for the pitch *l* (see FIG. 1).

Since a plurality of pairs of grippers 10 are connected to the endless transfer chain 8, the pairs of grippers 10 are also moved intermittently with the movement of the transfer chain 8 along the travelling path Y indicated in FIG. 1. As the set of grippers 10 in pairs are moved to the first station 11, then the cam follower 58 of each of the pairs engages with the raised portion 57a of the rail 57 so that the blocks 50 and 51 and accordingly the gripping members 79 and 80 are moved away from each other by the action of the toggle joint 54 (see FIG. 5). At the same time, each of the cam plate 150 of the gripper releasing devices 14 is raised by the action of the cam 155 engaging with the cam follower 156 mounted on the shifter lever 157 which is connected to the vertical shaft 153 and, thus, the actuating plate 140 of the releasing device 14 is moved to a position to cause the pinching projections of the gripping members to move away from each other (see FIGS. 5 and 10). On the other hand, the cam plate 113 of the pouch supplying device 20 is raised by the action of the cam 120 engaging with the cam follower 121 of the shifter lever 122 connected to the vertical shaft 117. This causes the roller 110 and accordingly the vacuum suction members 21 to move toward the openings 83 of the pouch stackers 19 so that the pouches a are taken by the vacuum cups 103 and 104 through the action of vacuum acting thereon as shown in FIGS. 7 and 8. At the next step, the retort pouches a supported by the vacuum suction members 21 are moved upward as shown in FIG. 7 by the action of the cam 128 mounted on the cam shaft 127 and engaging with the cam follower 129 of the shifter lever 130 to position in which both side edges of respective pouches are located between the pinching projections of the respective gripping members. At this time, the cam plate 150 is moved so that the actuating plate 140 of the gripper releasing device 22 is moved to a position to cause the gripping members 79 and 80 to grip the both side edges of the respective retort pouches. Thereafter, the pouch supplying vacuum suction members 21 are returned to their original positions due to the rotation of the cam 128. Thus, the first stage of the process is completed.

Figure 27:
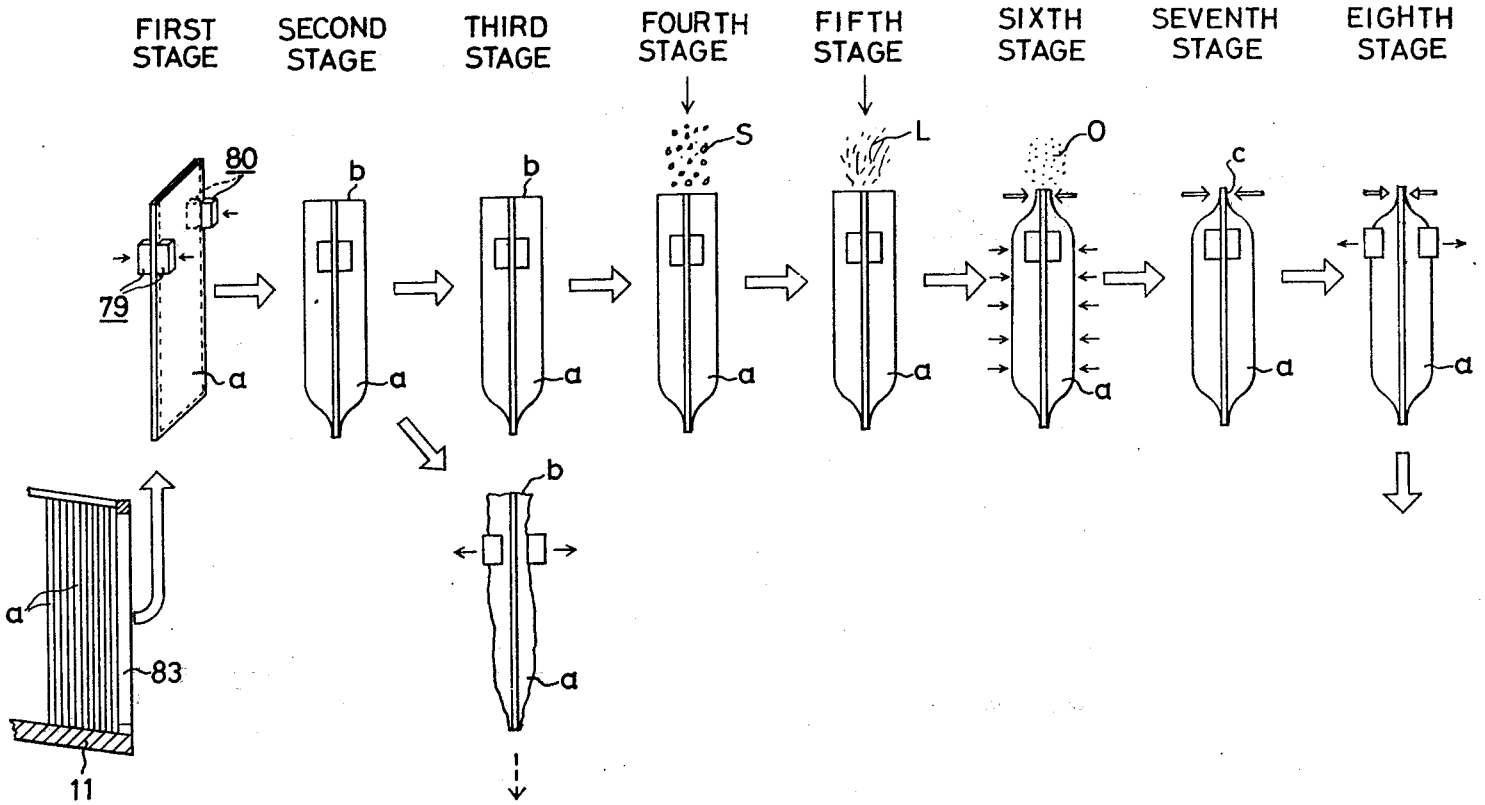
FIG. 27 is a diagram illustrating the process of the present invention.

In the second stage of the process, the grippers 10 supporting retort pouches are moved to the second station 12, in which each of the cam followers 58 of the grippers 10 disengages with the raised portion 57a of the cam rail 57 with a result that the gripping members 79 and 80 are moved toward each other by the action of the tension spring 60 cooperating with the toggle joint 54 for thereby relieving the strained conditions of the retort pouches. When this occurs, the cam 196 mounted on the cam shaft 119 in the area of the second station 12 is rotated to a position to cause the vertical shaft 194 and accordingly the cam plate 192 to move downward. Consequently, the cross bars 176 and 177 are moved toward each other by the actions of the tension springs 184, 185, 190 and 191 so that the vacuum cups 172 and 173 engages with opposite sides of the retort pouch *a*. Since, thereafter, the cam plate 192 is raised by the action of the cam 196, the side walls of the retort pouch a are pulled in opposite directions thereby to provide an opening b in the pouch a by the action of the vacuum acting on the opposite sides of the pouch. Then, the air funnel 24 is moved downward so that the outlet or the air nozzle 205 is entered into the pouch a by the action of the cam 208 and, at the same time, air under pressure is introduced into the retort pouch a through the nozzle 205 from the source of air under pressure whereby the retort pouch is completely dilated as shown in FIGS. 12 and 27. After the retort pouch has been completely dilated, the vacuum cups 172 and 173 of the pouch opening device 25 are moved away from each other by the action of the cam 196 while the air funnel 24 is moved upward by the action of the cam 208. Thus, the second stage of the process is performed.

In the third stage of the process, the grippers 10 each holding the retort pouch are moved to the third station 13, in which the dilated conditions of the respective pouches are sensed by the sensing means 27. If the retort pouch is satisfactorily dilated to a suitable shape, then the sensing means 21 does not generate an electric signal so that the solenoid (not shown) disposed between the source of fluid under pressure and the cylinder chamber 225 of the gripper releasing device is de-energized. Consequently, the fluid communication between the cylinder chamber 225 of the gripper releasing device 28 and the source of fluid under pressure is interrupted and, therefore, the piston 220 is urged to a position to cause the actuating plate 223 connected thereto to be held in a position away from the element 65 by the action of the compression spring 219 disposed in the cylinder 227. Thus, the gripper 10 is prevented from releasing the retort pouch, which is consequently passed to the fourth station as shown by a flow chart in FIG. 27. If, however, the retort pouch is not satisfactorily dilated to the suitable shape as shown in FIG. 27, then the sensing means 27 generates an electric signal, which is applied to the solenoid (not shown) thereby energizing the same. Accordingly, the fluid communication between the cylinder chamber 225 and the source of fluid under pressure is established so that the piston 220 is moved rightward as viewed in FIG. 14 against the action of the compression spring 219. Thus, the actuating plate 223 of the gripper releasing device 28 is caused to engage with the element 65 of the gripper thereby causing the same to releasing the defectively dilated pouch therefrom as shown in the flow chart of FIG. 27. The third stage of the process of the present invention is thus performed.

In the fourth stage of the process, the retort pouches are fed to the fourth station 14 below the hoppers 231 and 232 of the solid material supplying device 29. The retort pouches a reach their respective correct positions, then the sensing means 233 generate electric signals (ses FIG. 3). At the same time, the hoppers 231 and 234 are lowered by the vertical shaft 227 cooperating with the shifter lever 239 actuated by the cam 236 so that the outlets 234 of the respective hoppers 231 and 232 are positioned directly above the respective retort pouches. In this instance, the valves provided at the outlets 234 of the respective hoppers 231 and 232 are opened in response to the electric signals generated by the sensing means 233 and, therefore, the solid materials S are thrown or supplied into the retort pouches as shown in FIG. 27. After a certain time instant, the hoppers 231 and 232 are raised to their original positions by the cam 237 and, thus, the fourth stage of the process is performed.

In the fifth stage of the process, the retort pouches into which the solid materials S are supplied are fed to the fifth station 15 by the grippers 10 mounted on the endless transfer chain 8. The retort pouches a are then sensed by the sensing means 259, which generate electric signals. These electric signals are supplied to the solenoids (not shown) thereby to energize the same so that fluid under pressure is supplied to the cylinders 260 of the viscous liquid supplying devices 30. Consequently, each of the pistons 255 is moved to push the viscous liquid in the cylinder chamber 256 into the each of the retort pouches through the liquid delivering pipe 243 and the nozzle cylinder 245. It should be noted in this instance that the rotary cylinder valve 251 is held in a position to cause the valve opening thereof 258 to be aligned with the outlet 242 of the valve body 249 by the gears 253 and 261 which are driven by the pulleys 266 and 268 with the pulley 268 being rotated by the shaft 267 shown in FIG. 24. After the piston 255 has been moved to the position shown in FIG. 17, the piston 246 is moved downward as shown in FIG. 17 by the action of the cam 279 engaging with the cam follower 280 of the shifter lever 281 connected to the vertical shaft 274 (see FIG. 16) and, therefore, the remaining viscous liquid in the nozzle cylinder 245 is completely fed out into the retort pouch whereby the drippings of the liquid are prevented. After this operation, the retort pouches disengages from the respective sensing means 259 and, hence, the electric signals are not generated so that the piston 255 is moved to its original leftmost position. In this instance, the rotary cylinder valve 251 is rotated to assume a position shown in FIG. 17 so that the valve opening 258 is in communication with the inlet 257 to receive the viscous liquid from the hopper 270. This is achieved by the rotation of the gears 253 and 261 effected by the pulleys 266 and 268. After a certain time instant, the piston 246 is moved upward as shown in FIG. 16 and, thus, fifth stage of the process is performed.

In the sixth stage of the process, the retort pouches supplied with the solid materials and the viscous liquid are fed to the sixth station 16, where the each of the deflating devices 31 is actuated by the action of the cam 306 to release the remaining air O from each of the retort pouches as shown in FIG. 27. At the same time, the sealing device 32 is actuated by the action of the cam 340 so that the sealing bars 318 and 319 are moved toward each other as shown by a phantom line in FIG. 20 and the upper edge of each of the pouches is heated to a high temperature and sealed. After the primary sealing operation, the sealing device 32 is caused to move the heat sealing bars 318 and 319 away from each other by the rotation of the cam 340 and, thus, the sixth stage of the process is performed.

In the seventh stage of the process, the retort pouches are fed to the eighth station 18 where the sealing device 33 operates to perform secondary sealing of the pouches by the secondary sealing bars 352 and 353 which are moved toward each other to press the pouches from opposite sides thereof by the action of the cam 348. After the secondary sealing operation has been finished, then the sealing bars 352 and 353 of the sealing device 33 are moved away from each other by the action of the cam 348 and, thus, the seventh stage of the process is performed.

In the eighth stage of the process, the retort pouches are fed to the eighth station 18. In this instance, the cam plate 357 of the sealing device 34 is lowered by the action of the cam 362 engaging with the cam follower 363 so that the cooling bars 354 and 355 are moved toward each other thereby to engage with the opposite sides of the retort pouch for cooling the sealed portion c of the pouch as shown in FIGS. 10 and 27. The sensing means 373 sense the retort pouch and generate an electric signal, which is supplied to the solenoid valve (not shown) to energize the same. When the solenoid valve is energized, the fluid communication between the source of fluid under pressure and the cylinder chamber 375 of the cylinder 368 and, therefore, fluid under pressure is admitted to the cylinder chamber 375 so that the piston 370 is moved against the action of the compression spring 369 to a position to cause the actuating plate 372 to engage the member 65 to release the retort pouch. Each of the retort pouches thus released from the grippers is thereafter delivered through the passage 36 into some transfer means such as conveyor belt (not shown). Eighth stage of the process is thus performed.

It will now be understood from the foregoing description that according to the present invention each step of the process is automatically performed in a simple fashion.

It will also be noted that the apparatus of the present invention is so arranged as to treat a plurality of retort pouches at the same time in each station and, therefore, the working time is significantly reduced.

What is claimed is:

1. A filling and sealing apparatus for a plurality of retort pouches to store retort food stuffs comprising, in combination, an endless transfer means having a plurality of gripper means which are equally spaced from each other, said endless transfer means being intermittently movably disposed around an outer periphery of a platform, a first station including a plurality of pouch supplying means which are disposed in searies with respect to a travelling path of the retort pouches and a plurality of actuating means to actuate said grippers, said actuating means being actuable to cause said gripper means to grip the retort pouches, a second station including a plurality of retort pouch opening means and a plurality of retort pouch dilating means associated therewith to open and dilate the retort pouches gripped by said gripper means, said second station being located in the travelling path of the retort pouches at a position adjacent said first station, a third station located in the travelling path of the retort pouches at a position adjacent said second station and including a plurality of sensing means to sense opened conditions of the respective retort pouches for generating an electric signal when a defectively opened retort pouch is sensed, and a plurality of gripper releasing means responsive to the electric signal to cause said gripper means to release the retort pouch having a defective opening, a fourth station disposed in the travelling path of the retort pouches at a position spaced from the third station and including means for supplying solid materials into the retort pouches, a fifth station disposed in the travelling path of the retort pouches at a position spaced from the fourth station and including means for supplying viscous liquid into the retort pouches in which the solid materials is put, a sixth station disposed in the travelling path of the retort pouches at a position adjacent said fifth station and including a dilating means to release remaining air from the respective retort pouches and primary sealing means to primarily seal the opening portions of the respective retort pouches, a seventh station disposed in the travelling path of the retort pouches at a position adjacent the sixth station and including a secondary sealing means to secondarily seal the opening portions of the respective retort pouches which have been primarily sealed, an eighth station disposed in the travelling path of the retort pouches at a position adjacent the seventh station and including a cooling means to cool the sealed portions of the respective retort pouches for thereby solidifying the sealed portions and a releasing means to release the retort pouches, and driving means having means to intermittently move said endless transfer means at a preselected speed.

2. A filling and sealing apparatus according to claim 1, further comprising a driving socket and a plurality of driven sprockets rotatably mounted on the platform at spaced positions around the outer periphery of the platform, said endless transfer means engaging with said sprockets and driven thereby, a first drive line connected to said means of said driving means and driving said driving sprocket intermittently, and a second drive line connected to said driving means and including a group of cams which are driven in synchronism with the intermittent movements of said transfer means.

3. A filling and sealing apparatus according to claim 1, in which said plurality of gripper means are mounted on said transfer means within a space defined by a pitch of each of the intermittent movements of said transfer means and each of said stations has a width equal to said pitch.

4. A filling and sealing apparatus according to claim 1, in which each of said gripper means is mounted on a vertical plate fixedly connected to said transfer means and includes a pair of movable supporting blocks, arms extending in parallel to each other and connected to said supporting blocks, and gripping elements disposed on said arms.

5. A filling and sealing apparatus according to claim 4, in which said supporting blocks are operatively connected to each other by a tension spring and a toggle joint having a cam follower, said cam follower engaging with a cam rail mounted on the upper surface of said platform whereby said supporting blocks are movable toward and away from each other.

6. A filling and sealing apparatus according to claim 4, in which said gripping elements are urged in a direction to cause gripping action by compression springs respectively and movable in a direction to release the retort pouches by releasing elements.

7. A filling and sealing apparatus according to claim 1, in which said pouch supplying means includes a slidable member disposed on a frame in said platform, a first roller rotatably mounted on a stationary member, a second roller rotatably mounted on a movable member connected to said slider, said slider extending in a direction perpendicular to the travelling path of the retort pouches toward a pair of pouch stacker mounted on said first station, spring means for urging said slider in a direction away from said pouch stackers, a mounting plate connected to one end of said slider, a pair of vacuum suction means vertically slidably supported on said mounting plate and facing openings of said pouch stackers, a vertical shaft having a plate mounted at one end thereof, said plate engaging with said vacuum suction means for vertically moving said vacuum suction means, said vertical shaft being movable by one of the cams provided in said second drive line, and a cam plate engageable with said first and second rollers and movable in a direction to cause said slider to move toward said openings of said pouch stackers against the action of said spring means by the action of one of the cams in said second drive line.

8. A filling and sealing apparatus according to claim 7, in which said slider is slidably supported by a pair of guide plates having formed therein bores, said guide plates being mounted on the frame in said platform.

9. A filling and sealing apparatus according to claim 7, in which said vertical shaft is operatively connected to a shifter lever carrying thereon a cam follower engaging with the one of said cams, and in which said cam plate is connected to a vertical shaft having its one end connected to a shifter lever carrying thereon a cam follower engaging with one of said cams, said vacuum suction means and said cam plate being movable in synchronism with each other.

10. A filling and sealing apparatus according to claim 1, in which each of said gripper actuating means includes a pair of guide plates fixed to a supporting block mounted on said platform and having bores formed therein, a pair of shafts slidably received in the bores of said guide plates, a cross bar disposed between said guide plates and movable with said cross bar, an actuating plate connected to ends of said shafts, a first roller mounted on said supporting block, a second roller mounted on said cross bar, and a cam plate movable between said first and second rollers in a direction to move said second roller away from said first roller for thereby moving said actuating plate to move in a direction to cause said gripper means to release the retort pouches and movable in a direction to move said second roller toward said first roller for thereby moving said actuating plate in a direction to cause said gripper means to grip said retort pouches.

11. A filling and sealing apparatus according to claim 10, in which each of said gripper actuating means further includes a pair of tension springs disposed between said cross bar and one of said guide plates for urging said cross bar and accordingly said actuating plate in a direction to cause the gripper means to release the retort pouches.

12. A filling and sealing apparatus according to claim 11, in which said cam plate is connected to a vertical shaft which is vertically movable, said vertical shaft being connected at its one end to a shifter lever carrying thereon a cam follower engaging with one of the cams in said second drive line, whereby upward and downward movements of said vertical shaft is synchronized with the intermittent movements of said transfer means.

13. A filling and sealing apparatus according to claim 1, in which each of said retort pouch opening means includes a supporting block mounted on said platform, inner slidable shaft means slidably mounted on said supporting block, outer slidable shaft means slidably mounted on said supporting block and extending in parallel to said inner shaft means, first and second vacuum suction units connected to ends of said inner and outer shaft means, respectively, said first and second vacuum suction units having vacuum cups facing each other between which the retort pouch is disposed, said first and second shaft means being urged in a directions so that the vacuum suction units are urged toward each other, first and second rollers mounted on said inner and outer shaft means, and a cam plate movable between said first and second rollers in a direction to move said first and second vacuum suction units away from each other for thereby opening the retort pouch.

14. A filling and sealing apparatus according to claim 13, in which each of said pouch opening means further includes a pair of guide plates mounted on said supporting block and having a plurality of bores through which said inner and outer shafts slidably extend, cross bars disposed between said pair of guide plates and movable with said inner and outer shaft means, respectively, and a plurality of tension springs disposed between one of said cross bars and one of said guide plates and between the other one of said cross bars and the other one of said guide plates, whereby said vacuum suction units are urged toward each other.

15. A filling and sealing apparatus according to claim 14, in which each of said pouch opening means further includes a vertical shaft connected to said cam plate movable between said first and second rollers, said vertical shaft being connected to a shifter lever carrying thereon a cam follower engaging with one of said cams, whereby said cam plate is movable in synchronism with the intermittent movements of said transfer means.

16. A filling and sealing apparatus according to claim 1, in which said primary sealing means includes a supporting block mounted on said platform, inner and outer slidable shaft means slidably disposed on said supporting means and extending in parallel to each other, first and second sealing bars connected to ends of said inner and outer shaft means, respectively, first and second rollers mounted on said inner and outer shaft means, respectively, and urged toward each other, and a cam plate movable between said first and second rollers in a direction to move the rollers away from each other.

17. A filling and sealing apparatus according to claim 16, in which said primary sealing means further includes a pair of guide plates mounted on said supporting block and having a plurality of bores through which said inner and outer shaft means extend, first and second cross bars mounted on said inner and outer shaft means, respectively, first and second rollers mounted on said first and second cross bars, respectively, and a plurality of tension spring means disposed between said first cross bar and one of said guide plate and between said second cross bar and the other one of said guide plate for urging said first and second sealing bars toward each other.

18. A filling and sealing apparatus according to claim 17, in which said cam plate is connected to a vertical shaft which is slidably movable, said vertical shaft being connected to a shifter lever having a cam follower engaging with one of said cams, whereby said cam plate is movable in synchronism with the intermittent movements of said transfer means.

* * * * *